US008235765B2

(12) United States Patent
Falla

(10) Patent No.: US 8,235,765 B2
(45) **Date of Patent: *Aug. 7, 2012**

(54) COMPOSITE FABRIC LAMINATE FOR MAKING AN UNDERGARMENT

(75) Inventor: Gloria Falla, Demarest, NJ (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 161 days.

This patent is subject to a terminal disclaimer.

(21) Appl. No.: 12/725,868

(22) Filed: Mar. 17, 2010

(65) Prior Publication Data

US 2010/0297912 A1 Nov. 25, 2010

Related U.S. Application Data

(62) Division of application No. 10/997,016, filed on Nov. 24, 2004, now Pat. No. 7,682,219.

(51) Int. Cl.
*A41C 1/00* (2006.01)

(52) U.S. Cl. ..... 450/114; 450/117

(58) Field of Classification Search ..... 450/92, 450/93, 1, 39, 41, 46, 47, 49, 51, 52, 57, 450/109, 114–118, 122, 124, 156; 156/245, 156/73.3, 73.1, 73.4, 60, 88; 442/181, 182, 442/183

See application file for complete search history.

(56) References Cited

U.S. PATENT DOCUMENTS

| | | | |
|---|---|---|---|
| 2,126,833 | A | 8/1938 | Steinberger |
| 2,524,620 | A | 1/1950 | Cadous |
| 2,524,621 | A | 1/1950 | Cadous |
| 2,692,389 | A | 10/1954 | Lamkin et al. |
| 2,915,067 | A | 12/1959 | Bracht |
| 2,954,031 | A | 9/1960 | Froehlich |
| 3,064,329 | A | 11/1962 | Westberg |
| 3,070,870 | A | 1/1963 | Alexander et al. |
| 3,101,717 | A | 8/1963 | Korman |
| 3,114,374 | A | 12/1963 | Chalfin |
| 3,225,768 | A | 12/1965 | Galitzki et al. |
| 3,266,495 | A | 8/1966 | Sachs |
| 3,320,346 | A | 5/1967 | Galitzki |
| 3,327,707 | A | 6/1967 | Storti |
| 3,383,263 | A | 5/1968 | Storti |
| 3,497,415 | A | 2/1970 | Adachi |
| 3,502,083 | A | 3/1970 | Howard et al. |

(Continued)

FOREIGN PATENT DOCUMENTS

| | | | |
|---|---|---|---|
| CN | 1232652 | A | 10/1999 |

(Continued)

*Primary Examiner* — Gloria Hale
(74) *Attorney, Agent, or Firm* — Womble Carlyle Sandridge & Rice, LLP

(57) ABSTRACT

Feminine undergarments, particularly brassieres and other body shaping garments that are fabricated using a multi-layered fabric laminate that is formed by gluing multiple fabric layers together, preferably to permit body shaping garments to be substantially fabricated from a single main piece of material or blank cut from the multi-layered fabric laminate and which has finished edges which do not require separate binding or narrow edge finishing, together with a method of making such garments, both on an individual, batch basis, as well as an automated process for making the fabric laminate and multiple garments on a continuous basis, are disclosed. Multi-layer composite fabric laminate materials wherein different portions of at least one fabric layer thereof are made of different fabrics, and a method for making them, are also disclosed.

6 Claims, 16 Drawing Sheets

U.S. PATENT DOCUMENTS

| | | | | |
|---|---|---|---|---|
| 3,725,954 | A | | 4/1973 | Baldini |
| 3,799,174 | A | | 3/1974 | Howard |
| 3,881,041 | A | | 4/1975 | Glienke |
| 3,939,023 | A | | 2/1976 | Magidson et al. |
| 3,947,207 | A | | 3/1976 | Magidson et al. |
| 3,998,231 | A | | 12/1976 | Delet |
| 4,080,416 | A | | 3/1978 | Howard |
| 4,090,900 | A | | 5/1978 | Jacaruso et al. |
| 4,135,025 | A | | 1/1979 | Backes |
| 4,148,322 | A | | 4/1979 | Jacaruso et al. |
| 4,172,002 | A | | 10/1979 | Gluckin |
| 4,184,494 | A | | 1/1980 | King, Jr. |
| 4,202,853 | A | | 5/1980 | DiTullio |
| 4,214,319 | A | | 7/1980 | Bollag |
| 4,244,249 | A | | 1/1981 | DiTullio |
| 4,248,923 | A | | 2/1981 | Ciobanu et al. |
| 4,261,366 | A | | 4/1981 | Lamborn |
| 4,372,321 | A | | 2/1983 | Robinson |
| 4,375,445 | A | | 3/1983 | Cole et al. |
| 4,419,997 | A | | 12/1983 | Cole et al. |
| 4,481,951 | A | | 11/1984 | Cole et al. |
| 4,557,267 | A | | 12/1985 | Cole |
| 4,572,195 | A | | 2/1986 | Hyams |
| 4,604,152 | A | | 8/1986 | Liukko |
| 4,701,964 | A | | 10/1987 | Prunesti et al. |
| 4,767,377 | A | | 8/1988 | Falla |
| 4,776,916 | A | | 10/1988 | Prunesti et al. |
| 4,795,400 | A | | 1/1989 | Greenberg |
| 4,861,409 | A | | 8/1989 | Hashida et al. |
| 4,895,751 | A | | 1/1990 | Kato et al. |
| 4,957,466 | A | | 9/1990 | Hopps |
| 5,092,812 | A | | 3/1992 | Babcock |
| 5,154,659 | A | | 10/1992 | Gluckin |
| 5,165,113 | A | | 11/1992 | Hyams et al. |
| 5,240,538 | A | | 8/1993 | Hyams et al. |
| 5,359,732 | A | | 11/1994 | Waldman et al. |
| 5,385,502 | A | | 1/1995 | Moretz et al. |
| 5,406,646 | A | | 4/1995 | Balit et al. |
| 5,426,791 | A | | 6/1995 | Sydor et al. |
| 5,442,818 | A | | 8/1995 | Loos |
| 5,447,462 | A | * | 9/1995 | Smith et al. ..... 450/122 |
| 5,479,791 | A | | 1/1996 | Osborne |
| 5,487,189 | A | | 1/1996 | Bell |
| 5,507,681 | A | | 4/1996 | Smith et al. |
| 5,539,931 | A | | 7/1996 | Fizer et al. |
| 5,553,468 | A | | 9/1996 | Osborne |
| 5,590,548 | A | | 1/1997 | Osborne |
| 5,592,836 | A | | 1/1997 | Schuster et al. |
| 5,605,060 | A | | 2/1997 | Osborne |
| 5,611,722 | A | | 3/1997 | Osborne |
| 5,614,303 | A | | 3/1997 | Baigas, Jr. |
| 5,787,512 | A | | 8/1998 | Knox |
| 5,790,983 | A | | 8/1998 | Rosch et al. |
| 5,814,003 | A | | 9/1998 | Knox et al. |
| 5,816,889 | A | | 10/1998 | Fildan |
| 5,820,443 | A | | 10/1998 | Burr |
| 5,820,445 | A | | 10/1998 | Smith et al. |
| 5,873,768 | A | | 2/1999 | Fleischman-Ament et al. |
| 5,907,872 | A | | 6/1999 | Alberts et al. |
| 5,916,829 | A | | 6/1999 | Girard et al. |
| 5,938,500 | A | | 8/1999 | Hampton |
| 5,946,944 | A | | 9/1999 | Osborne |
| 5,953,754 | A | | 9/1999 | Rosch et al. |
| 5,983,394 | A | | 11/1999 | Joo |
| 5,984,762 | A | | 11/1999 | Tedeschi et al. |
| 6,000,994 | A | | 12/1999 | Salotto |
| 6,018,819 | A | | 2/2000 | King et al. |
| 6,023,789 | A | | 2/2000 | Wilson et al. |
| 6,048,253 | A | | 4/2000 | Larsen |
| 6,076,186 | A | | 6/2000 | Grose |
| 6,079,050 | A | | 6/2000 | Hooper-Jackson |
| 6,083,080 | A | | 7/2000 | Lawson et al. |
| 6,115,847 | A | | 9/2000 | Rosch et al. |
| 6,125,664 | A | | 10/2000 | Browder, Jr. |
| 6,134,718 | A | | 10/2000 | Sesselmann |
| 6,162,111 | A | | 12/2000 | Heroff |
| 6,178,784 | B1 | | 1/2001 | Marley, Jr. |
| 6,179,687 | B1 | | 1/2001 | Lee et al. |
| 6,192,521 | B1 | | 2/2001 | Alberts et al. |
| 6,192,717 | B1 | | 2/2001 | Rabinowicz |
| 6,287,168 | B1 | | 9/2001 | Rabinowicz et al. |
| 6,306,006 | B1 | | 10/2001 | Cheng |
| 6,336,840 | B2 | | 1/2002 | Heroff |
| 6,364,741 | B1 | | 4/2002 | Ferguson |
| 6,398,620 | B1 | | 6/2002 | Huang |
| 6,401,786 | B1 | | 6/2002 | Tedeschi et al. |
| 6,425,800 | B1 | | 7/2002 | Huang |
| 6,431,945 | B1 | | 8/2002 | Stephens et al. |
| 6,431,947 | B1 | | 8/2002 | Henz |
| 6,645,040 | B2 | | 11/2003 | Rabinowicz et al. |
| 2001/0000164 | A1 | | 4/2001 | Heroff |
| 2002/0000684 | A1 | | 1/2002 | Nakanishi |
| 2002/0002023 | A1 | | 1/2002 | Nakanishi |
| 2002/0023709 | A1 | | 2/2002 | Tedeschi et al. |
| 2002/0031978 | A1 | | 3/2002 | Heroff |
| 2002/0111119 | A1 | | 8/2002 | Johnson et al. |
| 2002/0155785 | A1 | | 10/2002 | del Olmo |
| 2002/0155786 | A1 | | 10/2002 | Querquant |
| 2003/0013379 | A1 | | 1/2003 | Henz |
| 2003/0092355 | A1 | | 5/2003 | Rabinowicz et al. |

FOREIGN PATENT DOCUMENTS

| | | | |
|---|---|---|---|
| DE | 20011261 | | 2/2001 |
| DE | 19942996 | A1 | 3/2001 |
| EP | 734660 | A1 | 10/1996 |
| EP | 875612 | A2 | 11/1998 |
| EP | 1033084 | A2 | 9/2000 |
| EP | 1123666 | A2 | 8/2001 |
| FR | 1282812 | A | 1/1962 |
| FR | 2487734 | A1 | 2/1982 |
| FR | 2782611 | A3 | 3/2000 |
| FR | 2785154 | A1 | 5/2000 |
| FR | 2792173 | A1 | 10/2000 |
| FR | 2820001 | A1 | 8/2002 |
| FR | 2823075 | A1 | 10/2002 |
| GB | 1237196 | A | 6/1971 |
| GB | 1348132 | A | 3/1974 |
| GB | 1470928 | A | 4/1977 |
| GB | 2265077 | A | 9/1993 |
| JP | 9031856 | A | 2/1997 |
| JP | 2000226703 | A | 8/2000 |
| JP | 2000314011 | A | 11/2000 |
| JP | 2001073203 | A | 3/2001 |
| JP | 2002155403 | A | 5/2002 |
| JP | 2002201505 | A | 7/2002 |
| WO | WO-9843503 | A1 | 10/1998 |
| WO | WO-0121019 | A1 | 3/2001 |
| WO | WO-0185516 | A1 | 11/2001 |
| WO | WO-0207548 | A1 | 1/2002 |

* cited by examiner

FIG. 12B
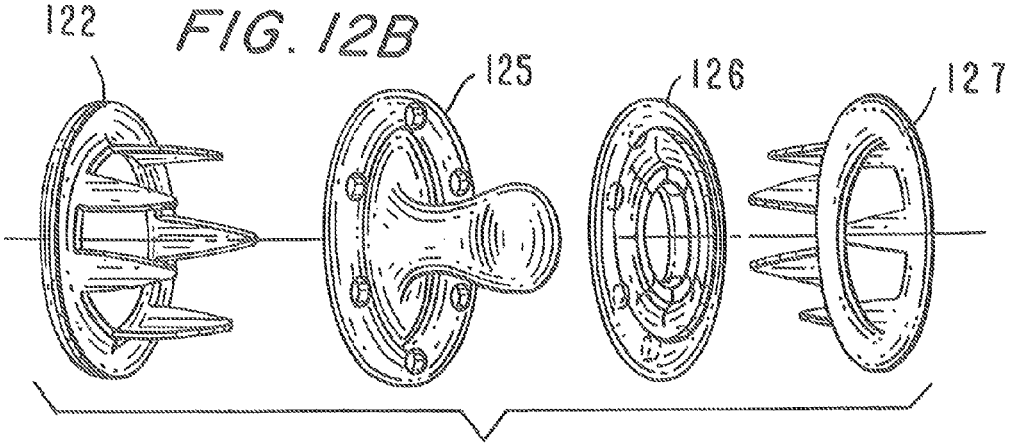
FIG. 12C
FIG. 13B
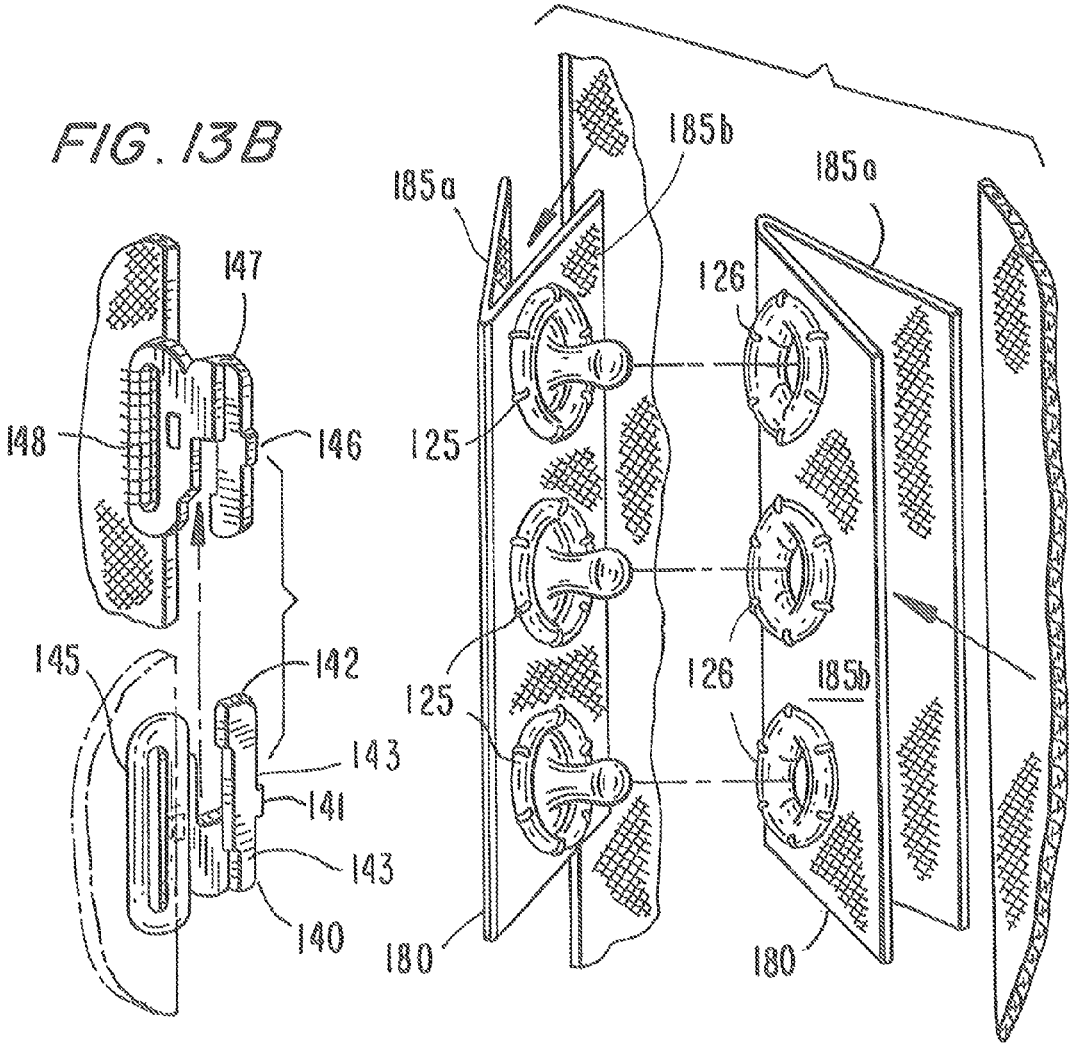

COMPOSITE FABRIC LAMINATE FOR MAKING AN UNDERGARMENT

CROSS REFERENCE TO RELATED APPLICATIONS

This application is a divisional application of application Ser. No. 10/997,016, filed Nov. 24, 2004, now U.S. Pat. No. 7,682,219.

FIELD OF THE INVENTION

This invention relates to feminine undergarments, particularly brassieres and other body shaping garments fabricated using a multi-layered fabric that is formed by gluing multiple fabric layers together, preferably to permit body shaping garments to be substantially fabricated from a single main piece of material or blank cut from the multi-layered fabric laminate and which has finished edges which do not require separate binding or narrow edge finishing.

BACKGROUND OF THE INVENTION

In the garment industry, particularly in the field of manufacture of undergarments, especially women's undergarments, sometimes referred to as body shaping garments, such as, brassieres and figure persuasive panties, there has been a constant effort by designers to develop garments that not only provide figure enhancement, but are as well comfortable to wear, non-binding, non-chaffing, lightweight and aesthetically pleasing, preferably presenting no visible lines through the wearer's outer clothes. As well, there has been a long felt need to have garments which are easily manufactured and to the greatest extent possible reduce the production steps and incorporate the significant use of automated assembly and eliminate as many as possible of the labor-intensive and time-consuming manufacturing steps, such as sewing or stitching, which even when done using mechanized sewing machines is still nevertheless a lengthy and time consuming process.

Historically, these objectives were often incompatible. To provide shaping and contouring it was often desirable to include multiple layers of material in selected locations and with the need for multiple layers came the need for multiple sewing steps—and multiple seam lines. Moreover, the line of transition between sections separated by seam lines often presented an area of stiffness as well as an abrupt transition, which created fit and comfort problems. Even in single layer garments bordering edges have to be finished with sewn on bindings or narrow elastics and even in the latter case the stretch characteristics of the narrow elastics has not been fully compatible with the fabric it borders. Moreover, use of bordering elastics or tapes result in a thicker edging, which not only tends to press inward of the body of the wearer, it is often visible through outer clothing. As well, all of the sewing steps are time-consuming and labor-intensive, involving multiple sewing operations to assemble the garment from its cut-out parts.

In recent years, advances have been made in the development of new fabrics, including both synthetic fabrics and blends of natural and synthetic fabrics, which could be used for undergarments. These fabrics are generally softer and more supple than predecessor materials, yet are capable of providing shape and control, either alone or in combination with other materials sewn or applied to them, so as to provide adequate support and body shaping for the wearer. Many of these new fabrics have elastomeric properties providing a modulus of elasticity and others are stretchable with a significantly lesser degree of elastic recovery. There has thus resulted softer and more supple fabrics to provide a greater level of comfort and aesthetic appeal, but these also were labor intensive to make and seam lines and bordering tapes and elastics were required.

More recently, advances have been made in the use of adhesive securement of fabrics that can, in some instances provide a substitute for sewing. These adhesives include thermoplastic adhesives that are heat actuated which are capable of bonding with fabrics to form a tight chemical as well as physical bond. These thermoplastic adhesives are available in a number of forms, including as a film, web, powder, print, spray, and aerosol. However, this only provided a partial solution as only zones or sections of the garment were glued or adhesively bonded while other sections were either conventionally sewn or otherwise pieced together.

Even in instances where it has been suggested that the process of manufacturing can be better automated by the use of adhesive technology to bond fabrics, and cutting blanks from sheets or rolls of the fabric, these blanks still generally require many additional finishing steps to provide shaping and/or body constricting and/or contouring benefits, especially in brassieres.

For example, U.S. Pat. No. 5,447,462 to Smith et al, entitled "Fabric Laminate and Garments Incorporating Same", which issued Sep. 5, 1995, and is assigned to the assignee as the present invention, describes multi-layer stretch fabrics, which are used to form discrete portions of the garment in which it is desired to provide certain control properties. Although the selective use of stretch control laminate fabrics provided a step forward, the fabric laminates of the '462 patent are intended to be used only selectively and not for the entire body of the garment. If the materials of the '462 patent were used as the principal fabric, the garment would be too constricting and/or the entire garment rather than only selected portions of a garment would have the same controlling features throughout.

Moreover, the '462 patent does not solve the problem of the discontinuity in the stretch characteristics at the boundary lines between the principal fabric of the garment and any additional fabric laminated which may be present in selected areas. Not only do the junctures produce surface irregularities, which are less than satisfactory both from the perspective of the "feel" of the garment on the wearer's skin and from an aesthetic viewpoint the discontinuities can lead to the leaving of an impression on the wearer's skin, following a pattern of the discontinuities caused by the pressure of the fabric on the skin and the differences in the height of the different fabric constituents over the fabric surface.

Still another important consideration in the manufacture of garments from multi-layered fabrics or even a single layer of material is the ability to produce a garment whose borders will not fray or unravel, even after repeated wearing and laundering. As previously referred to, this has been accomplished by the use of bindings or finishing materials, which in the case of brassieres are often narrow strips of elastomeric materials. This border elastic material provides both control and a finished edge binding. However, because the narrow elastics are of a dissimilar material to that of the principal fabric of the body of the garment and are generally thicker, there is a discontinuity of stretch characteristics and surface height to that of the main body of the garment. As a consequence, the fit, contour and stretch characteristics of the edges of the garment are less than optimally mated to the principal fabric used in the garment.

Based on the foregoing, it is evident that there is a need in the field of apparel manufacture, especially undergarment manufacture, and more particularly, women's undergarments, such as brassieres and underpants, for a fabric that will enable manufacture of a garment substantially from a fabric, which is a multi-layered fabric laminate, made from a plurality of individual fabric layers which can all be made from the same fabric or which can be made from different but compatible fabrics, and wherein the laminate fabric can be made to have any or all of a desired set of properties especially important in the fabrication of undergarments, including softness, suppleness the ability to provide support and control, and the ability to enable fabrication of the undergarments with a minimum of or with total elimination of edge stitching and/or the use of narrow bordering materials. There is as well a need for the fabric to provide a variety of both stretchable and non-stretchable and elastomeric and non-elastomeric zones, all of which can be easily and relatively inexpensively manufactured using highly automated means and involving a minimum of labor-intensive manufacturing and assembly steps.

Accordingly, it is one object of the present invention to provide in a body shaping garment a multi-layered fabric material, composed of at least two layers of fabric, made from materials that have compatible characteristics which enable them when secured together either along their entire extent—or at least along those portions which provide the bordering areas of a finished garment to form a material which has elastomeric characteristics at least along a portion of the garment and in which at least two layers of fabric are adhered to one another by an adhesive material applied in a manner to cause adhesion of one layer of fabric to its immediately adjoining layer and which as joined provide a generally self-finished edge when the fabric is cut as a blank into a desired shape.

For efficiency in manufacture the multi-layered fabric laminate material is fabricated using adhesive material applied over the surface of adjoining layers of fabric in a manner to cause adhesion of the adjoining layers over only those selected portions of the surface areas thereof that are in communication with one another and to which adhesive material has been applied, and further so as to cause adjoining layers of fabric in other than these selected portions to remain non-adhered, but integrally a part of the laminate.

The adhesive material is preferably a thermoplastic adhesive material that is heat actuated and is adapted to be applied in a number of ways, including, but not limited to, as a film, as a powder, as a print, as a web, and as an aerosol spray deposition.

In accordance with the present invention the blank created and which is suitable for finishing as a body shaping garment is adapted to include supplemental materials such as additional panels or stiffeners, or shape-imparting materials.

In its preferred form the invention is die cut to form a blank or series of blanks for use in the manufacture of a woman's brassiere or control panty, with the resultant garment having little or no stitching and affords increased comfort to the wearer due to the absence of seam lines and surface irregularity and provide improved aesthetic appearance, with little or no outlines of the undergarment being visible through outer clothing.

SUMMARY OF THE INVENTION

According to the present invention, garments in general and women's brassieres and underpants in particular, are manufactured from a dual layer fabric including a first fabric and a second overlaid fabric, which fabrics are adhered to one another by an adhesive material between the adjacent layers of fabric. The individual fabric layers can be selected from natural or synthetic materials, or materials that are a blend containing both. The individual fabric layers can be made of stretchable or non-stretchable materials, but preferably at least one includes elastomeric materials. The individual fabric layers can be made of the same material or they can each be made from different materials. Where at least one of the fabric materials of one of the layers is stretchable and contains elastomeric material, having a coefficient of elasticity or elastic modulus, at least selected portions of the fabric that is adhered to that layer preferably includes stretchable characteristics which enable the superimposed plies of the multi-layered laminate to stretch in at least selected areas.

Preferably an adhesive material is placed in the adjacent layers of fabric. The adhesive, material can be of the type that is actuated and has adhesive properties immediately upon application to a layer of the fabric material, or of the type that must be separately actuated to exhibit its adhesive properties. Thermoplastic adhesive materials constitute a preferred example of the latter category. Thermoplastic adhesives are typically dry to the touch prior to activation. Adhesive resins are one preferred form of thermoplastic adhesive material that can be used in the manufacture of the fabric laminates. The adhesive resin may be in the form of film, web, dry powder, print, spray or aerosol when applied to the layers of fabric material that are to be adhered. Preferred thermoplastic adhesive resin materials include polyamides and polyurethanes. A particularly preferred polyamide thermoplastic adhesive resin material for use in the present invention is a ternary elastomeric material, having a melting temperature in the range of from about 105° C. to about 175° C.

An additional benefit of the present invention is that the multi-layer fabric laminate material can be made from an almost infinite variety of natural, synthetic, or a natural and synthetic blended material, and provided at least some portion of the laminate is stretchable, other non-stretchable fabrics can be used as well. Thus when the fabric laminate is assembled with the layers in superimposition to one another at least in part, those parts having elastic properties and/or stretch characteristics are capable of stretching together.

To the extent that the adhesive material which is provided between each pair of adjacent layers of fabric material, covers the corresponding surfaces of each pair of adjacent layers upon actuation of the adhesive material, the adjacent layers of fabric materials whose respective surfaces are in contact with the adhesive material are caused to adhere to one another. Although adhesion throughout the entire extent of the fabric is not required, it is highly desirable that the adhesive material is provided at least along an extent of the fabric which will, upon creation of the blank provide a finished edge to the major bordering perimeter of the blank which will be the perimeter of the finished body shaping garment.

A further aspect of the present invention is to provide new multi-layer composite fabric laminate materials for use in the manufacture of undergarments, wherein at least one layer of the composite fabric laminate is made of at least two different fabrics which abut one another within a layer of the laminate. Such composite fabric laminate materials can also be made to have from two to as many as six layers.

A still further aspect of the present invention is to provide a process for fabricating the various fabric laminates, fabric blanks for garments made therefrom, and the garments themselves, on both an individual blank/garment or "batch" basis, as well as on a semi-continuous or continuous basis wherein multiple blanks and garments can be assembled, processed, and completely manufactured simultaneously.

DETAILED DESCRIPTION

Figure 1:
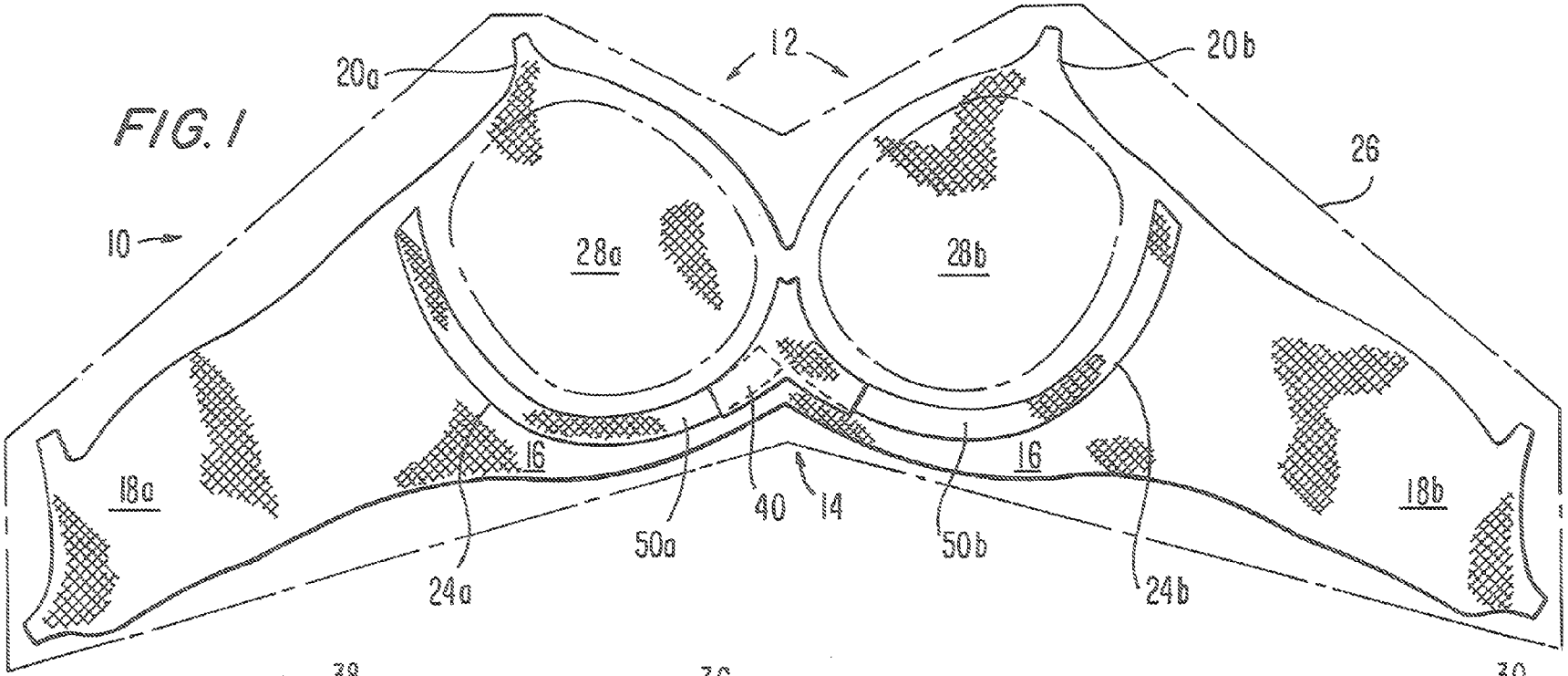
FIG. 1 is a top plain view of one embodiment of a fabric laminate blank for the manufacture therefrom of a brassiere in accordance with the present invention.

As is used herein, the term facing surface refers generally to either side of a piece of fabric. As is well known to those of ordinary skill in the art, a piece of fabric has what is known as a technical front and a technical back. The technical front and the technical back of any piece of fabric may have the same or different finishes, which may, for example, be smooth or textured. The terms technical front and technical back refer to the front and back of a sheet of fabric as it is made on the knitting machine, and do not necessarily correspond to a front and back, respectively, of the fabric as it is incorporated in a fabric laminate according to the present invention. Where only one side of the piece of fabric is smooth, and the other is textured, the smooth side is generally referred to as the front (which may or may not be the same as the technical front of the fabric as it is made on the knitting machine) and the textured side is generally referred to as the back (which may or may not be the same as the technical back of the fabric as it is made on the knitting machine). In a fabric with a smooth face, the fabric may have a gloss or sheen on that side. In a fabric with a relatively rough or textured back, the fabric may have a dull or "porous" appearance on that side. Where one side of the piece of fabric has a design or pattern therein, or has a bright or colored surface, while the other side is matte, plain, monotone, or uncolored, the former side is generally referred to as the front and the latter as the back.

In a two fabric layer fabric laminate according to the present invention, the laminate may be formed such that either the front or the back of one layer of the fabric is adhered to either the front or the back of the other layer of fabric, depending on a number of considerations, including utilitarian considerations regarding which two sides of the two fabric layers are most compatible from the perspective of being glued together, as well as from comfort and aesthetic considerations.

It is also to be understood that in the construction of a fabric laminate according to the present invention, there are certain facing surfaces of the individual fabric layers that make up the fabric laminate that will be internal or interior to the fabric laminate and certain facing surfaces of the individual fabric layers that make up the fabric laminate that will be external or exterior to the final fabric laminate. Internal or interior facing surfaces face inwardly into the interior of the fabric laminate and external or exterior facing surfaces face outwardly away from the interior of and to the exterior of the fabric laminate. All fabric laminates have two external or exterior facing surfaces and at least two internal or interior facing surfaces. Thus, for example, a two-fabric layer fabric laminate has two external or exterior facing surfaces and two internal or interior facing surfaces (one facing surface of each fabric layer faces outward and one faces inward), whereas a three-fabric layer fabric laminate has two external or exterior facing surfaces and four internal or interior facing surfaces (one facing surface of each of the two outer layers faces outward, one facing surface of each of the two outer layers faces inward, and both facing surfaces of the inner layer of fabric are considered to be inwardly facing). Additionally, the two external facing surfaces of any fabric laminate can be further classified with respect to their orientation in a final garment made from the blank, as either an interior external facing surface, which is the side of the fabric laminate that faces toward the wearer of the finished garment, and an exterior external facing surface, which is the side of the fabric laminate that faces away from the wearer of the finished garment.

For example, in the fabrication of a brassiere from a two-layer fabric laminate wherein the two fabric layers are made of different materials, one material may have a brightly colored floral pattern on one side, for aesthetic appeal, and have a textured surface on the opposite side. The second fabric layer, of a different fabric material, may have a smooth, satin-like surface on one side, for comfort, and have a textured surface on the opposite side. The fabric laminate would be labeled such that the front of the first fabric was the side with the floral pattern thereon, and the back of the first fabric was the textured side; the front of the second fabric was the smooth, satin-finish side and the back of the second fabric was the textured side. The fabric laminate would be assembled such that the backs of the two fabric layers were juxtaposed with the adhesive web placed therebetween because the textured sides of the fabric layers provide a better surface for adhesion of the adhesive; the front of the first fabric would be the exterior external face of the assembled laminate, for aesthetic reasons; and the front of the second fabric layer would be the interior external face of the assembled laminate, for comfort reasons.

A surface of one of the fabric layers of a fabric laminate according to the present invention may have one facing surface that will become an exterior external face of the laminate that is printed with a pattern, such as a floral pattern, an animal pattern, such as tiger stripes, or leopard spots, etc.; has a pattern embossed thereon, such as, for example, a Jacquard pattern, in a floral or another design motif; or may have a lace finish applied thereto.

Also as used herein the terms single-piece and single main piece; referring to garments fabricated according to the present invention, means garments wherein the body or main portion of the garment is made from what is substantially one piece of fabric laminate, wherein the fabric laminate is itself, however, made from multiple layers of fabrics that may be the same or different, and/or wherein even individual fabric layers may be made from composites of different fabrics that are abuttingly adhered to one another to form a single contiguous piece of fabric. The terms are used to distinguish garments according to the present invention from prior art type garments that are fabricated from a plurality of individual parts that are needed to form the main body of the garment, which parts must be attached to one another, typically by sewing, so as to form even the main body of the garment, exclusive of any accessories, such as straps, closure devices, etc., that may later be attached thereto in completing the fabrication of the garment.

Referring now generally to the accompanying drawing figures, FIG. 1 depicts an illustrative brassiere blank 10 cut out from an extent of laminated fabric made in accordance with the present invention prior to its being finished into a brassiere. The blank 10 generally includes the main portions of the finished brassiere, namely breast receiving cup portions 12 with a central area 28 which can be readily molded into a three dimensional cup shape; a central medial portion 14 extending between respective inner cup edges; an undercup portion or underbust portion 16 which is adapted to lie generally flat against the chest wall of a wearer beneath the cups; side panels 18 which extend from respective outer cup areas which together with the front portions of a brassiere provide a body encircling arrangement; and shoulder strap securement sections 20, to provide a securement tab for shoulder straps which extend over the shoulders of a wearer and generally terminate along a portion of the side panels 18 (not shown) near the back securement means (not shown) which conventionally provide closure to back closure type brassieres.

The blank 10 illustrated is exemplary and it is intended to provide a general teaching to those skilled in the art. It will be readily appreciated that other styles of brassieres, such as non-underwires, front closure styles and other styles can all employ the benefits of the invention. The blank 10 illustrated in FIG. 1 is for finishing as an underwire brassiere.

An underwire channel section 24 is provided within the blank 10 to receive therein or thereon a channel member 50 which, in turn, receives an arcuately or "U"-shaped wire (not shown) of metal or plastic of the type employed in brassiere design for enhanced cup perimeter shaping and breast support. A channel member 50 is provided for each of the two cups of the bra. The channel members are attached to one layer of the fabric of the laminate, preferably on a facing surface thereof that will be interior to the laminate when it is glued together, prior to assembly and gluing together of the several layers of the laminate. The channel members 50 are typically stitched to the surface of the layer of fabric to which they are to be attached, however, they may also be glued in place or fuses to the fabric.

The blank 10 is preferably a single extent, thus eliminating the need for a central welding or joining of the cup portions 12. If desired, the central medial portion 14 can be reinforced by the adhesive emplacement either between the fabric layers or on an outer surface of one of the fabric layers of a central gore or gusset member 40 (see FIG. 5).

As illustrated in FIG. 1, the perimeter of the blank 10 is cut-out in the shape of a smooth, straight edge 26. The fabric laminate used in the manufacture of garments according to the present invention provides a finished edge that is smooth and resists unraveling, so that additional edge finishing steps are not required. According to certain embodiments, a decorative edge, such as a scalloped edge 27, can be provided. Still other edge configurations can also be provided. The self-finishing edge eliminates the need of edge tapes and/or narrow elastic finishing parts, and has the benefits of additional comfort and aesthetics. Since the self-edge is of the same material as the principal fabric laminate of the brassiere, its properties are generally the same as the main body of the garment. Thus, there is no abrupt transition between the principal fabric and the bordering portions of the brassiere. As well, the thickness of the edge of the finished brassiere is generally the same as that of the principal fabric, thus providing a smooth surface in intimate contact with the body of the wearer and as well provides a smooth outer surface where the finished brassiere comes into contact with the user's outerwear.

According to certain embodiments, a curvilinear shaping to the edge, such as the scalloped edge 27 serves to enhance these beneficial attributes. This scalloping of the edges enhances the aesthetic appeal of the garment, however, garments can be made with a straight edge, with substantially equal durability. Among other things, the provision of a curvilinear or scalloped edge does, however, permit a slight fanning out of the fabric to better engage the body, particularly along the underbreast and lower side panel areas to better accommodate the shape of the wearer given the generally inverted truncated cylindrical shape of the chest cavity. As well, it permits adaptability of the upper portions of the side panels 18 to the fleshy underarm area as the side panels 18 extend about the body, under the arms of the wearer through an area, which often includes softer body tissue. Moreover, and as further explained with regard to the fabric, which is formed of at least two layers glued together, it provides a more aesthetically compatible finish along the die cut edge.

Referring now to FIGS. 2 A-B, which illustrate various types of two fabric layer fabric laminates made according to the present invention, FIG. 2 A shows one form of a two-layer fabric laminate material, wherein a first layer 30 of an elastomeric material preferably incorporates spandex fabric. In this embodiment, layer 30 of fabric is placed in juxtaposition to a layer of a dry ternary elastomeric polyamide thermoplastic adhesive resin material 32, having a melt temperature in the range of from about 109° C. to about 170° C. Preferably, the adhesive is in the form of a loosely and amorphously woven filamentous web. Depending on the garment to be produced from a particular fabric laminate, the web adhesive 32 is alternatively applied to cover either an entire first surface of the first layer of fabric 30, as shown in FIG. 2 A; or only over selected portions thereof, as shown in FIG. 2 B.

For example, where the fabric laminate is to be used in the manufacture of brassieres, it may be desired in certain embodiments that the adhesive web not be applied to selected portions of the fabric layers, particularly in the regions of the blank that will become the main portion of the cups 12 of the brassiere, so that when the adhesive web material 32 is thermally activated to actuate the adhesive properties of the adhesive to cause adhesion of the adjacent fabric layers 30, 34, the fabric layers 30, 34 will remain unadhered in at least that part of the regions of the brassiere cups 12.

Figure 10:
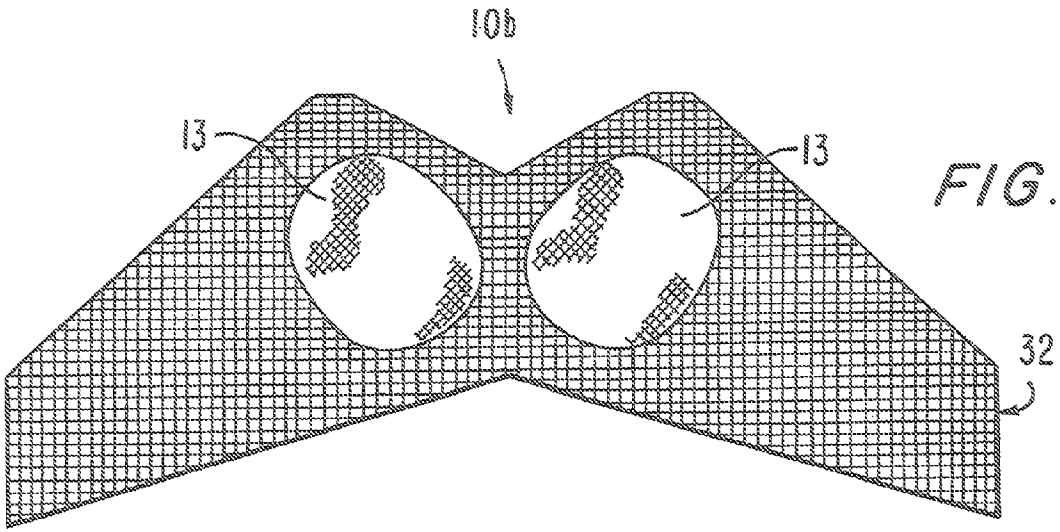
FIG. 10 is a top plan view of one embodiment of a blank for the manufacture therefrom of a brassiere according to the present invention, wherein the adhesive web layer does not cover certain selected portions of the two surrounding fabric layers, such that only those portions of the fabric layers that are exposed to the adhesive web are glued together in the final blank after heat treatment.

Referring to FIG. 10, the adhesive is in the form of a web that is to be subsequently thermally actuated using a hot-melt process to cause the fabric layers to become adhered to one another. Where it is desired that certain portions of the fabric laminate blank not be glued together, adhesive-free portions 13 of the adhesive web corresponding to those portions on the surface of the blank (e.g., in the two cup regions) 32 *b*, where it desired that the fabric layers not be glued together are provided, so that upon actuation of the adhesive, there will be no adhesive present in those regions, as is shown in FIG. 2 B. The fabric layers will become glued together only in those regions 32 *a* where there is adhesive present.

Figure 2A:
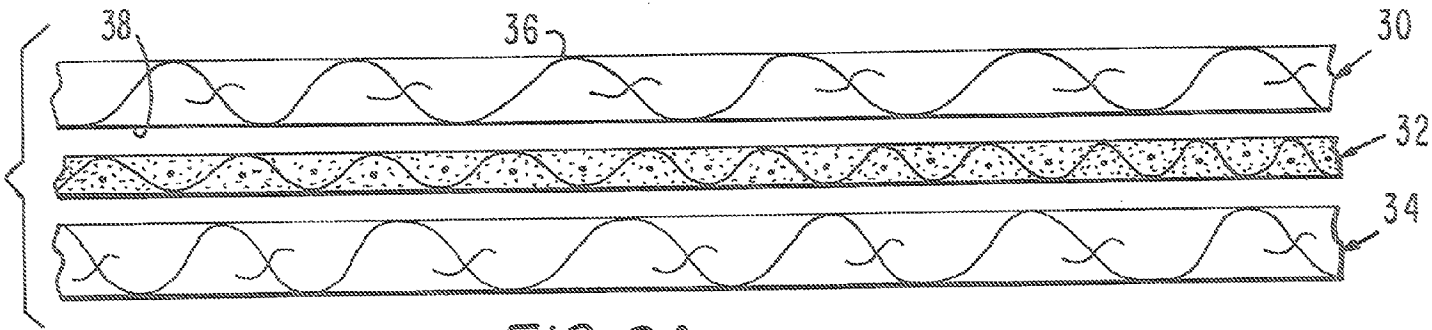
FIGS. 2 A and B are side cross-sectional views, partially exploded, of embodiments of a two layer fabric laminate with an adhesive material therebetween, according to the present invention.
Figure 2B:
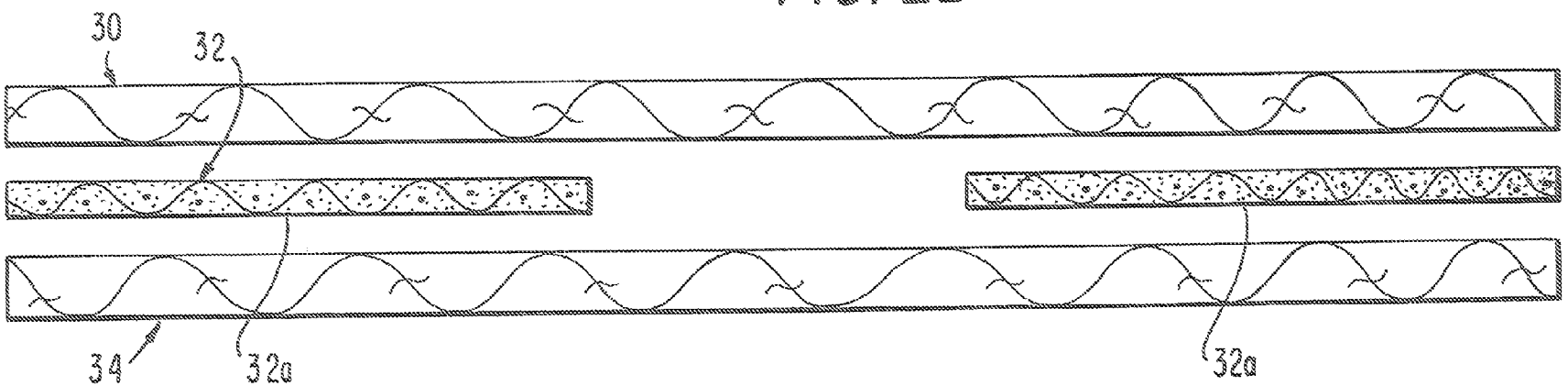

In certain other embodiments of brassieres made according to the present invention, it may be desired that the two or more individual layers of fabric that comprise the fabric laminate in the region of what will become the cups of the brassiere be glued together. In such embodiments, as shown in FIG. 2A, the adhesive is simply applied to cover the entirety of the adjacent facing surfaces of the fabric layers of the laminate. These embodiments offer the advantage of being easier to assemble in that generally, the entire surface of the fabric layers that are in contact with each other are glued over their entire surfaces, thereby not requiring the additional time for selective application of the adhesive to certain selected portions of the layers of fabric that will become the glued fabric laminate. Where the adhesive is in the form of a web, this eliminates the need for an extra step of cutting out those portions of the web where it is desired for there to be no adhesive.

Where the fabric laminate is to be used to produce controlling panties, the web adhesive 34 is generally applied to the entire first surface of the first layer of fabric 30 with the second layer being an elastomeric fabric that is stretchable and includes an elastomeric such as synthetic spandex material 32. This second layer is positioned over the adhesive web 34.

According to certain embodiments of panties, it similarly may be desired that the entirety of the surface of the blank not be glued together. For example, in certain embodiments of panties that incorporate molded rear "buttocks support" panels in the buttocks region, it may be desired that the fabric layers of the laminate not be glued together in those places.

As previously noted, the individual layers or plies of fabric material used in the formation of the fabric laminate typically each have characteristic first and second sides or surfaces, which, depending upon the material, may be the same or different. This layer of fabric may have a front and a back that are different due to the manner in which that particular fabric is manufactured. Referring to FIG. 2, for example, a first front surface 36 of a layer of fabric 30 may have a smooth finish with a gloss or sheen to the material, while a second, back surface of the layer of fabric 38 may have a relatively flat, relatively rougher texture to promote better adhesion.

A similar orientation may be provided with respect to fabric layer 32 such that the surface in the final garment that contacts the wearers skin is smooth and both visible surfaces on the garment have the greatest aesthetic appeal.

Figure 3:
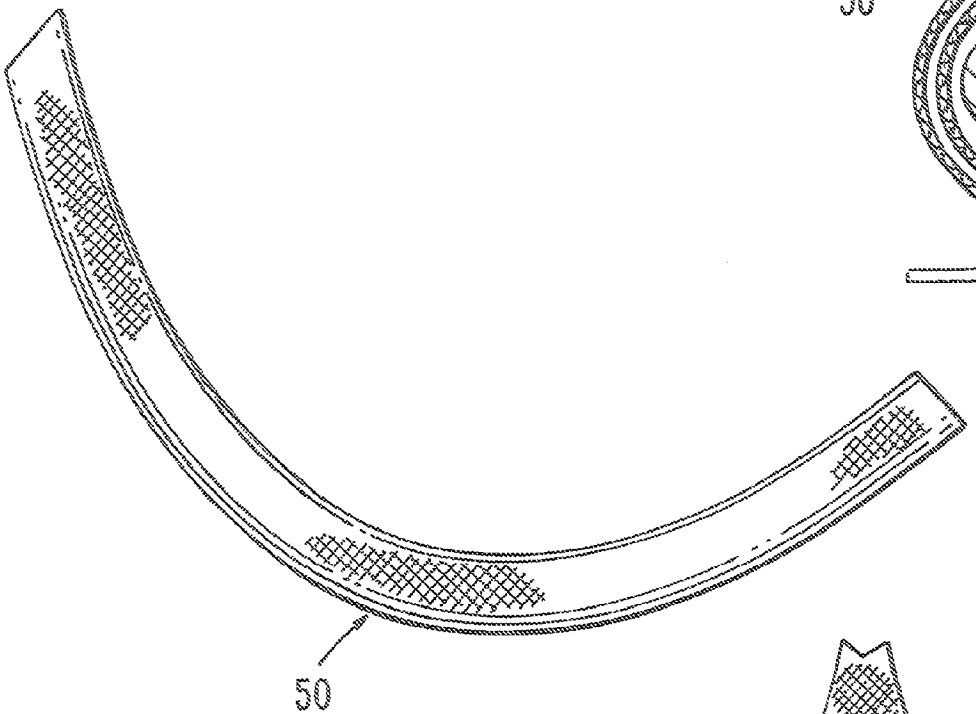
FIG. 3 is an elevational view of one embodiment of an underwire channel, which can be incorporated in a brassiere blank of the present invention.

If desired, additional non-glued zones can be provided between layers and/or supplemental fabric panels can be provided. For example, as illustrated in FIG. 1, an underwire channel 24 for accepting an underwire can be provided. Referring to FIG. 3, a supplemental channel material 50, which may be the same as or different from the fabric or fabrics of the fabric laminate, is placed between the fabric layers and is preliminarily stitched or adhesively secured to one of the fabric layers before assembly and gluing of the laminate.

Figure 4:
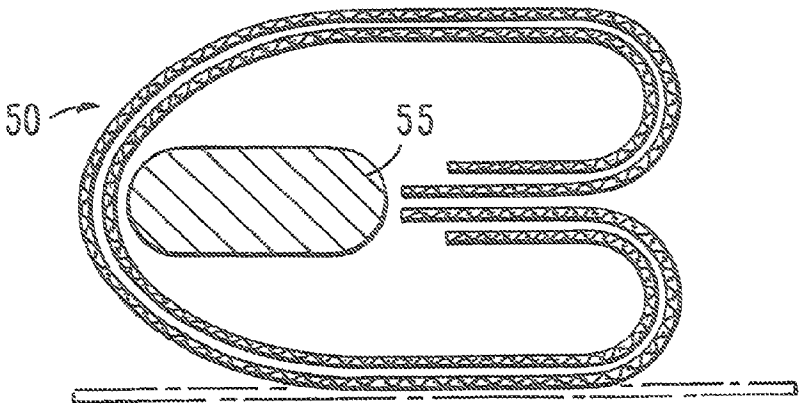
FIG. 4 is a cross-sectional view of an alternative embodiment of an underwire channel that is a double needle wire channel, which can be incorporated in a brassiere blank of the present invention.

According to a preferred embodiment, the channel material 50 generally comprises a narrow piece of a single ply of material or multiple plies of one or several different materials, that are folded to form a tube, as shown in FIG. 4. The channel material is secured to the surface of one layer of the fabric laminate in a desired area just below the area that will become the cups of the brassiere when a blank is cut from a sheet of the fabric laminate. Although the channel material is presently typically sewn or stitched to the fabric laminate, it is preferable to utilize an adhesive to glue the channel material in place so as to eliminate the stitching step. It is preferable that the channel material be attached to a facing surface of one of the fabric layers that will become an interior-facing surface of the fabric laminate when it is assembled. When the channels are sewn to the outer surface of the fabric laminate that will become the interior surface of the final garment that is in contact with the wearer's skin, the channel material and the stitches used to fasten it to the laminate surface can create a source of discomfort and irritation. When the channel material is attached to the outer surface of the fabric laminate that will become the exterior surface of the final garment, facing away from the wearer, it can cause aesthetic problems in that it tends to create a bulge on the outer surface of the garment that may be visible through the wearer's outer clothing and destroys the "invisible" look of the garment. Therefore, it is preferable that the channel material first be attached to an inner surface of one of the layers of the fabric laminate prior to formation of the laminate by actuation of the thermoplastic adhesive that holds the several layers together. The channels themselves typically have an arcuate or "U" shape. One end of each channel that faces toward the interior of the blank is sealed off by stitching or gluing at the time the channel is attached to the fabric layer, and the opposite end of each channel usually extends to and abuts the outer peripheral edge of the blank and is left open until a subsequent step of inserting the underwire therein is completed, after which the channel is completely closed off by stitching or gluing it closed. Where it may be desired to have less than fully extending channels that do not extend to an outer peripheral edge of the blank, the channel material, it is also necessary to insert the metal or plastic channel reinforcing and shaping underwire into the channel before the laminate is formed to prevent the need for puncturing the formed laminate to insert the wire at a later stage of manufacture of the garment. Some preferred fabrics for the channel material include brushed nylon and nylon taffeta.

Figure 5:
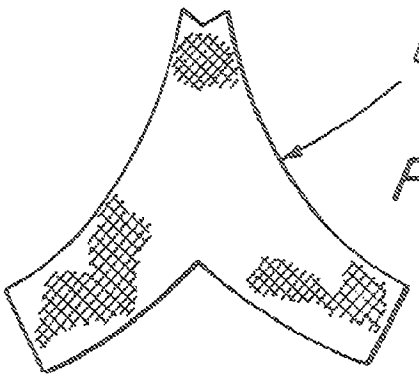
FIG. 5 is an elevational view of a supplemental medial central support insert or gore for a brassiere, which can be incorporated into a brassiere blank of the present invention.

As shown in FIG. 5, a central reinforcement panel or gore 40, for emplacement at the center of the brassiere, between the cups, can be sandwiched between fabric layers 30 and 34 to provide reinforcement at that location. In the assembly of the laminate, the selected portions of the fabric can be readily indexed to pre-select those areas where adhesive is or is not to be applied, and/or where other materials, such as a center gore 40 or other stabilizing and reinforcing material, and/or a wire and channel material are to be attached to or incorporated within the fabric laminate. Typically, the gore is made from a polyester knit, preferably a circular polyester knit.

As is schematically illustrated in FIG. 2, according to one embodiment, the fabric laminate incorporates two layers of fabric, at least one of which is made from a yarn that incorporates an elastomeric material, preferably spandex; and is itself, as well as the garment made from a blank cut from the fabric, made on a batch or individual basis.

According to this embodiment, individual blanks for individual garments are prepared separately from squares or rectangles of the individual fabric layers, typically of a size of about 12 inches by about 30 inches. The thermoplastic adhesive is applied between the two layers of fabric before they are placed together. The dry thermoplastic adhesive may be applied to what will become an inner surface of one of the fabric layers as a dry powder, as a spray, or as a web. The second pre-cut piece of fabric, typically of about the same dimensions as the first piece, and which may be of the same or a different, albeit compatible from the point of its stretch properties, material, is then placed on top of the first piece of fabric and the adhesive. Prior to placement of the second fabric layer of fabric and/or prior to application of the adhesive, any other inserts, such as a gore or other reinforcing and stabilizing side panels, and/or a channel and reinforcing/shaping wire, are also inserted. After the multi-layer "sandwich" of two fabric layers, together with any inserts and the adhesive, has been formed, it is ready for heat treatment to actuate the adhesive and seal the layers and inserted materials together over at least those portions that have been exposed to adhesive, to form the final fabric laminate.

In still other embodiments, multi-layer fabric laminates of three or more layers or plies of the same or different, but compatible fabrics are made by the same general process as described above, with the further provision that the adhesive is applied between each and every adjoining fabric layer over whatever portions of the contacting surfaces of the layers it is desired to achieve permanent adhesive contact when the adhesive material is actuated.

The foregoing process for making blanks, which is also more fully described in greater detail herein below, is a "batch" process wherein the blank for each garment is separately and individually made. This process can, however, be automated to a continuous or semi-continuous basis wherein a plurality of blanks can be made sequentially from a roll of fabric laminate, and even wherein the roll of fabric laminate is itself made on a continuous basis from a plurality of rolls of material, with there being a individual roll for each layer of the fabric laminate, and even for the adhesive material where it is in the form of a web of the adhesive material.

Figure 8:
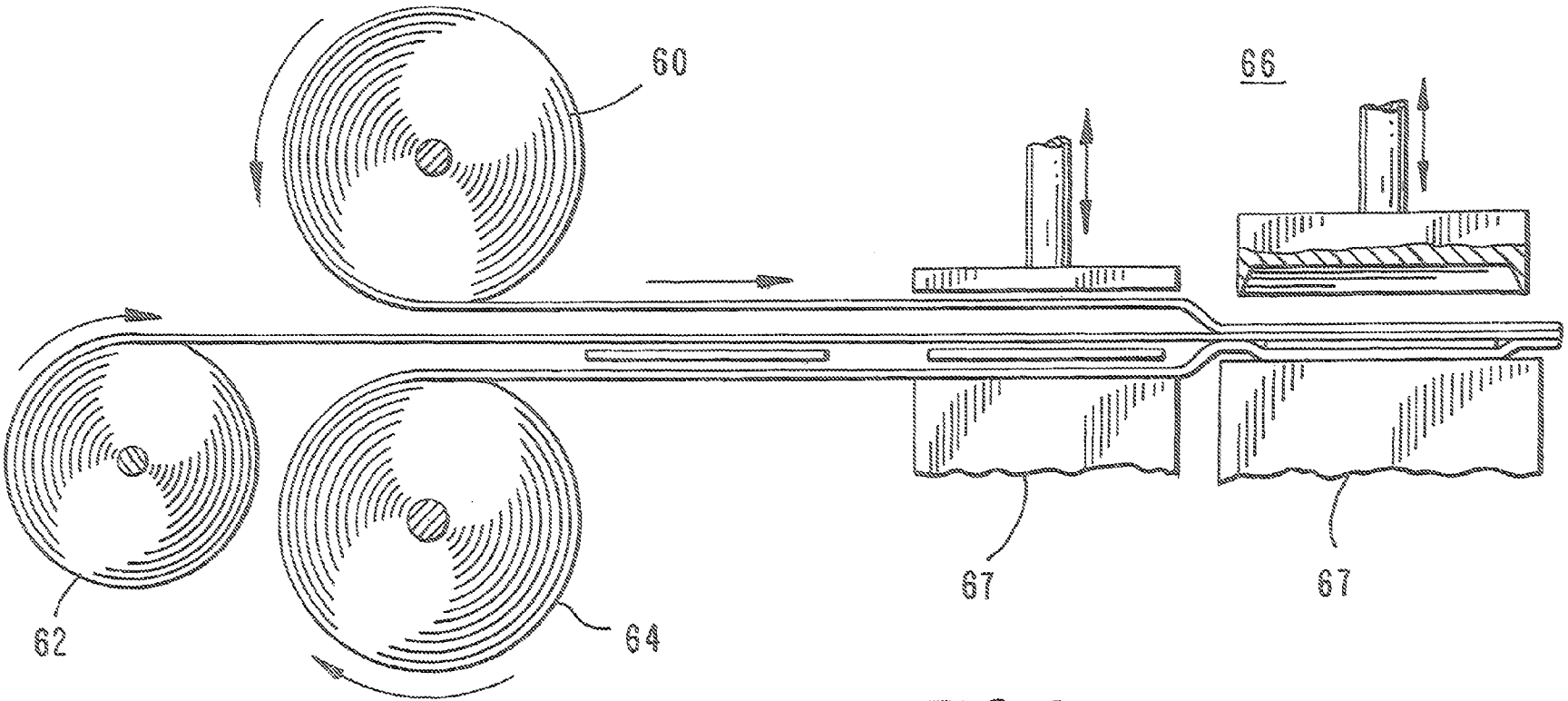
FIG. 8 is a schematic showing the layout of a continuous method for the formation of a multi-layer fabric from rolls of individual fabric layers, and the formation of a plurality of fabric blanks for the manufacture of brassieres from a roll of the final fabric laminate.

Such a continuous basis process is schematically illustrated in FIG. 8. As illustrated, the fabric laminate material incorporates two layers of fabric at least one of which has a yarn which incorporates a spandex material, thus imparting elastomeric characteristics to the fabric. The fabric parts are laminated using a polyamide thermoplastic adhesive resin web placed between them. The fabrics are fed from rolls 60, 64 with the adhesive web 62 fed therebetween. The adhesive material is then heat-activated, such as by passing the assembled laminate through a heat-treatment step 66, wherein the laminate is supported on a platen 67 and the laminate is formed by subjecting the layers of material to a thermal, hot-melt process to actuate the adhesive by softening it and bringing it to its melt temperature, whereupon fabric-to-adhesive bonding occurs to adhere the two layers of fabric material, and any other intermediate gore or other reinforcing and/or channel materials, to the molten adhesive, and thus also to one another.

The hot-melt process involves the formation of both chemical and physical bonds between the adhesive material and the layers of fabric, due to a combination of temperature and pressure effects, but does not so restrict or bind up the fabric and interstitial spacing or "pores" in the fabrics to significantly impair air permeability or stretch characteristics.

The hot-melt process is typically carried out in several stages, including a "heating" stage and a "cooling" stage. The temperature at which the heating stage is conducted must be at least at or slightly above the melt temperature of the adhesive material being used. For most adhesive materials, the melt-temperature and temperature of the heating stage is in the range of from about 100° C. to about 200° C. This is well below temperatures, which would damage or otherwise affect the physical characteristics of the fabric used in the multi-layer laminate. The second, or cooling stage of the hot-melt process is conducted at a lower temperature to cause the adhesive material, which is still in a molten or semi-molten state exiting from the heating stage, to be rapidly cooled so that it sets and forms chemical bonds and physical bonds with the fabric layers and other inserted reinforcing and/or channel materials, thereby causing all layers and pieces of the laminate to adhere to one another.

The heating stage of the hot-melt process is conducted at pressures that are sufficient to cause the molten adhesive to spread and bond with the fabric layers with which it is in contact, without penetrating or bleeding through the fabric, while chemically bonding with the fabric layers. The cooling stage of the hot-melt process is conducted at a pressure sufficient to keep the elements of the laminate tightly bound together until the adhesive cures and seals all of the layers and pieces together.

Generally, the dwell time for each of the heating and cooling stages should be on the order of from about at least about 10 seconds, up to a maximum time of about 90 seconds. Typically, the dwell time in each stage is about equal. Determination of the individual stage and total dwell times is a matter of optimization that depends on the natures of the fabric layers and other materials and the nature of the adhesive material. Such determinations can readily be made by persons of ordinary skill in the art.

After the fabric laminate has been formed from the individual layers of fabric material(s), any intermediate stabilizing, reinforcing, and/or channel materials, and the adhesive material, in the hot-melt process, the fabric laminate is allowed to cool and is then ready for the production of blanks therefrom, from which individual garments are made. The blanks are then cut out using die cutting or other suitable means.

It should be noted that the fabric laminate can be produced either on a batch basis as individual squares or rectangles of material from which a single blank or several blanks are subsequently cut using cutting dies 68; or on a continuous basis, from a long sheet of fabric laminate material which is rolled as it is formed, and from which a large number of individual garment blanks can subsequently be cut.

It is also understood that garments may be assembled from fabric laminates made from and incorporating different fabrics, all such fabric laminates being made in accordance with the present invention.

For example, sections of a garment which are desirably non-stretchable may be formed of a two-layer fabric laminate which does not stretch to be secured to a two layered laminate of a stretchable elastomeric fabric. The several sections of the two fabric laminates are then laid out such that the different sections of the final garment are adjacent to one another. The garment is then assembled by first applying an adhesive material along juxtaposed sections and activating the adhesive to cause the several layers to adhere to one another. At the juncture of the first and second sections, as well as any other sections of the garment, the joining lines can further be glued or spot-welded on the exterior surfaces of the garment to produce a more complete and more aesthetic joint between adjacent sections of the garment.

Figure 9:
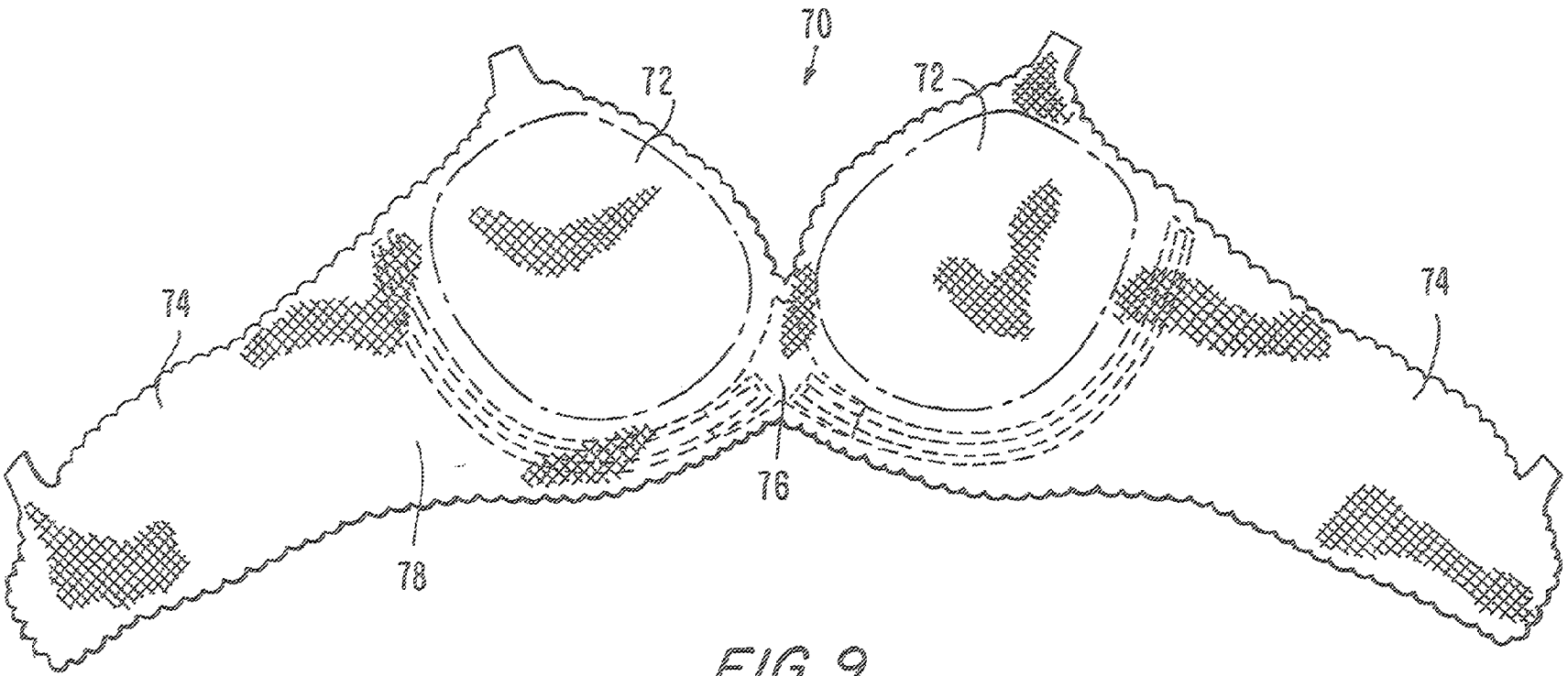
FIG. 9 is a top plan view of one embodiment of a fabric laminate blank for the manufacture therefrom of a brassiere in accordance with the present invention, wherein the edges of the blank have been finished with a decorative cut, scalloped edge.
Figure 11:
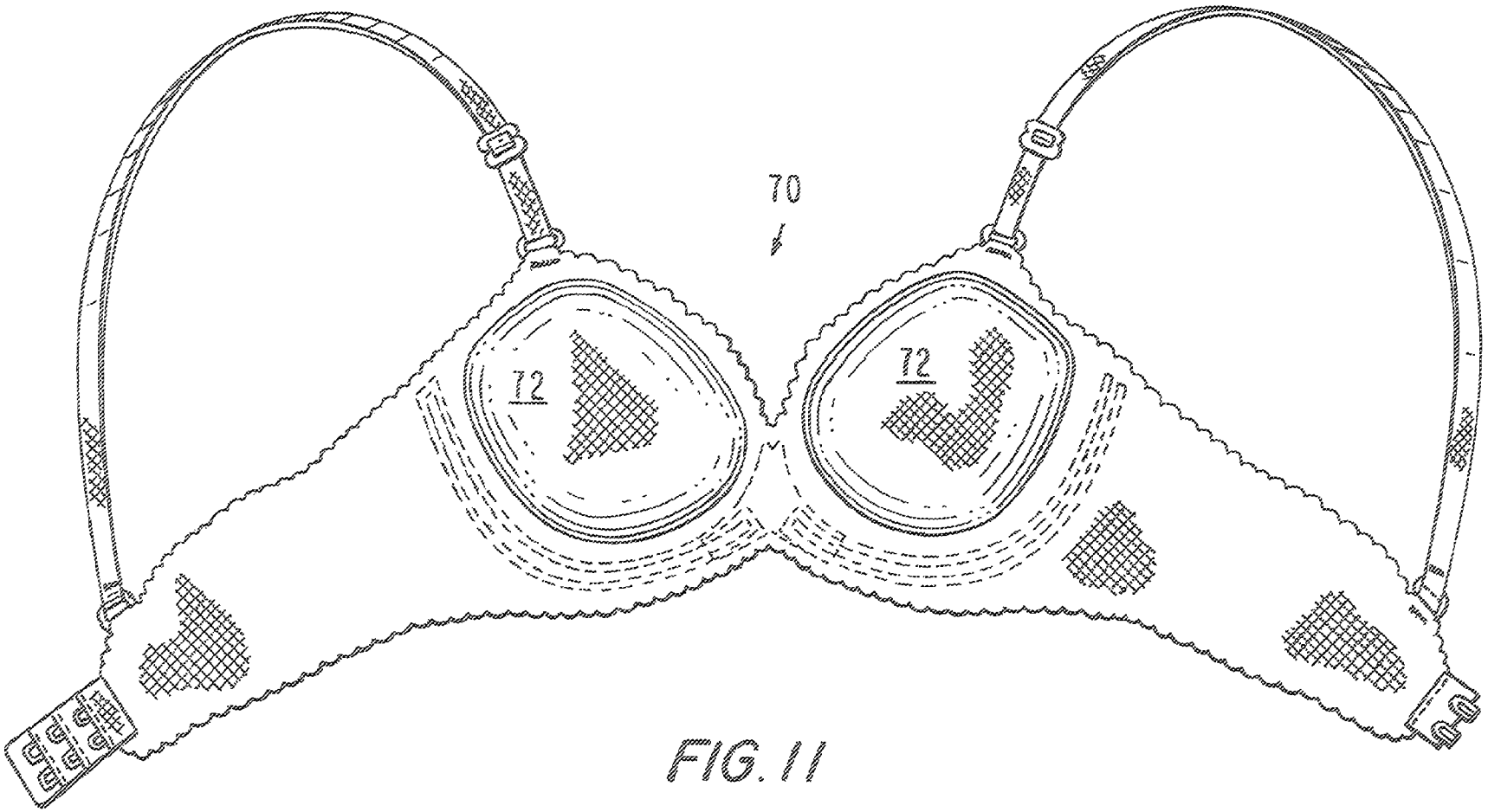
FIG. 11 is a perspective view of a finished back-closing brassiere in accordance with the present invention.

FIG. 9 illustrates a finished brassiere 70, including breast cups 72 made from a first fabric laminate made from two layers of a stretch fabric and having two side sections 74, each made from a stretchable elastomeric synthetic spandex blend fabric. The adhesive material used to join the fabric layers of the two different fabric laminates together, as well as adhering the stabilizing and reinforcing joining materials as well as a gore insert 76 in the front body section, is a thermoplastic polyamide adhesive resin material, in the form of a web positioned at joining junctures and is either exposed on the inner surface of the brassiere or preferably itself covered by a stretchable, but not necessarily elastomeric fabric to provide a smooth inner finished surface to the brassiere.

Figure 17A:
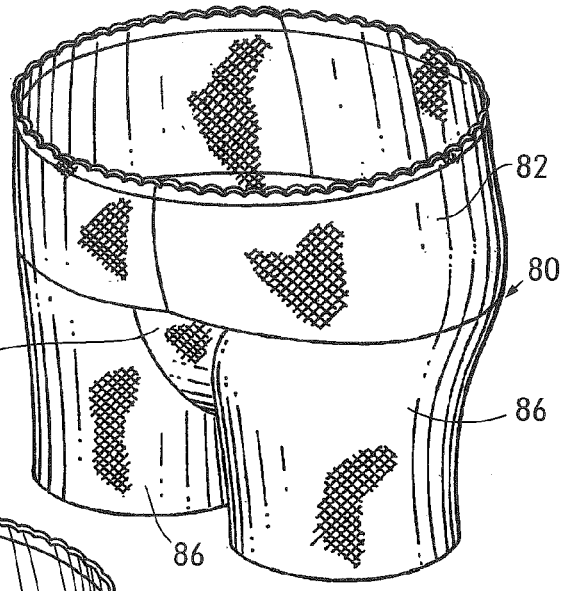
FIG. 17 is a perspective view of a finished control panty in accordance with the present invention.
Figure 17B:
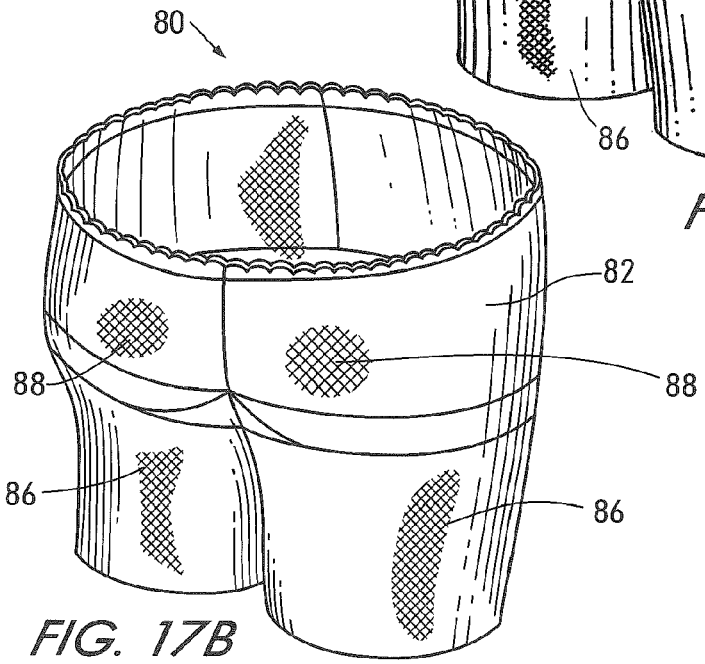

FIGS. 17A and 17B illustrate a controlling panty 80 made in accordance with the present invention, with the two fabric layers adhesively bonded together as shown in FIGS. 2A and/or 2B. As shown in the Figures, the controlling panty body may comprise a singular body portion 82, or multiple body portions, including front, rear, side, or combination thereof, and a crotch portion 84, as will be appreciated in the art. As shown, the panty 80 may further comprise leg portions 86. As shown in FIG. 17B, body shaping regions 88 may be formed as non-bonded areas in the buttocks region, in a manner such as that shown in FIG. 2B. Each layer of the two fabric layers can be seamlessly knit in a manner known in the art—with the adhesive placed therebetween or the fabrics can be made by non-seamless construction with a glued seam provided for joining panels or parts thereof.

Thus, multi-layered garments in general and most beneficially undergarments having body shaping characteristics can be formed which permit the finishing of the garments without the need of supplementary binding or finishing elastics and which preferably provide a single unbroken extent of substantially equal thickness about the major extent of the garment for greater comfort, fit and ease of manufacture.

Generally, a brassiere made according to the present invention further include a pair of shoulder straps for enabling the garment to be worn properly and comfortably by the wearer without shifting. A shoulder strap is attached to each side of the garment at the front, to the outer side of the cup area, and at the back, on each side panel of the garment.

The shoulder straps are generally attached by sewing each end of the strap to the garment at the point of attachment. It is preferable, however, also with the objective of reducing or totally eliminating the need for sewing in the fabrication of the garment, both from a comfort and aesthetic viewpoint, as well as a labor and cost saving measure, that the straps be attached by gluing or fusing the strap material to the main garment at the points of attachment. The straps can be made from either a stretch or a non-stretch fabric, and are typically made from cotton, polyester, or nylon. The straps also preferably have means on each strap to adjust its length. The straps are fabricated according to methods known in the art.

Generally, a brassiere made according to the present invention also has fastening means attached thereto to enable the wearer to easily fasten the garment after putting it on, and easily unfasten the garment when it is desired to remove it. The fasteners involve the attachment of cooperating parts of a closure device to each end of the left and right end panels of the bra. Typically, the most commonly used fasteners include "hook and eye" type fasteners, with at least one, and typically a plurality of two or three hooks being attached to the open end of one end panel and the corresponding number of eyes being attached to the open end of the opposite end panel. The hooks and eyes may be attached by sewing or stitching them to the end panel. They may also be glued to the fabric of the end panel. Where a plurality of hooks and eyes are used, they may first be separately attached to pieces of fabric, with all hooks being attached to one narrow strip of fabric and all eyes attached to another narrow strip of fabric. Each individual strip of fabric is then attached to each respective open end of the garment. The individual strips may be attached to their respective end panels by sewing or stitching or by gluing or fusing the fabric strips to which the hooks and eyes are respectively attached to the fabric of the end panels.

Alternatively, snaps may be used instead of hooks and eyes. Typically, a plurality of from two to four snaps are used, with either all the male or all the female parts of all the snaps being attached to one end of one end panel and the cooperating opposite parts being attached to the opposite end panel. The parts of the snaps may each be attached separately, by sewing or stitching, or by gluing them to the fabric of the respective end panels, or they may first all be attached to respective fabric strips for attachment to the open end of each end panel of the garment, which strips are then attached by sewing or stitching, or preferably by gluing or fusing the fabric strips to the fabric of the end panels. Another alternative form of fastener is to use Velcro®, also referred to as "hook-tape", strips, with one strip of material bearing the "hook" portion, actually a plurality of micro-sized hooks or barbs, being attached to one open end panel of the garment, and a strip of material bearing the "eye" portion, actually a mass of a fibrous or filamentous material which the hooks engage with, being attached to the opposite open end panel. The Velcro® strips can be attached to the respective end of the end panels by sewing or stitching, or preferably by gluing or fusing the base material portion of each piece of Velcro® to the fabric of the respective end panel of the garment.

Whatever type of closure device is utilized, it should be able to resist a tensile strength of at least about 30 pounds without opening.

According to certain embodiments of brassieres of the invention, it is also possible to make the width of the garment adjustable by attaching a number of sets of fasteners of whatever type is selected (typically, only a plurality of one end of each cooperating fastening device is used) at multiple positions on at least one end panel of the garment so that it can be closed in a plurality of alternative positions of different overall width in order to accommodate the individual wearer's chest width size as nearly and as comfortably. This also enables the wearer to adjust the fit of the garment to account for size changes due to natural variations in size caused by weight gain or loss.

According to yet other embodiments of a brassiere of the present invention, the garment can be fabricated to have a front closure feature. In such an embodiments, the end panels which usually are open ended and have the closure means attached, as described above, are formed as a single piece and the garment is left open at the front between the cups, in the region of the gore insert. The closure or fastening means, of any of the same types as described above for use as a back closure means, such as a hooks and eye fastener, snap fasteners, Velcro®, or hook-tape, is then provided attached to the respective open front ends of the garment. Alternatively, closure devices developed specifically for front closure brassieres, such as barrel catch closure devices, may also be used in this type of brassiere.

Figure 15A:
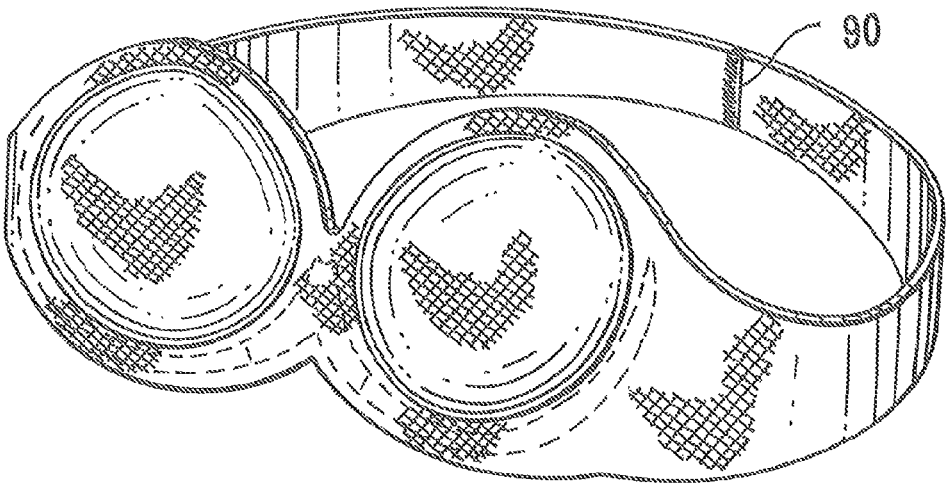
FIGS. 15 A and B are perspective views of finished tubular type brassieres, strapless and with straps, respectively, in accordance with the present invention.
Figure 15B:
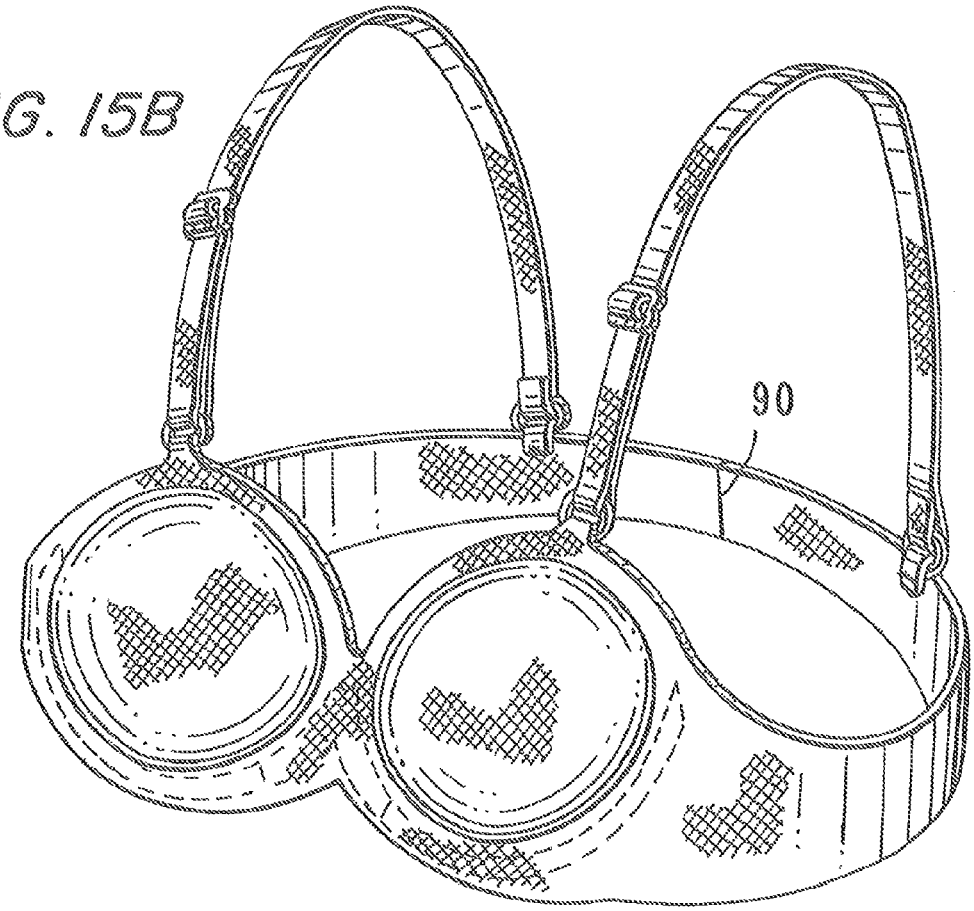
Figure 16A:
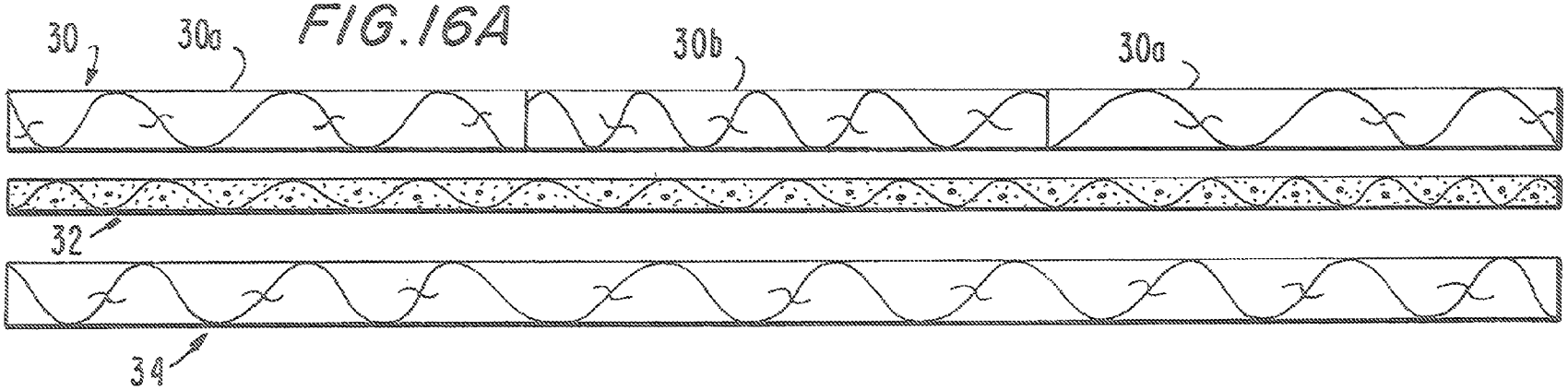
FIGS. 16 A-F are side cross-sectional views, partially exploded of alternative embodiments of a two fabric layer composite fabric laminate with an adhesive material therebetween, according to the present invention.
Figure 16B:
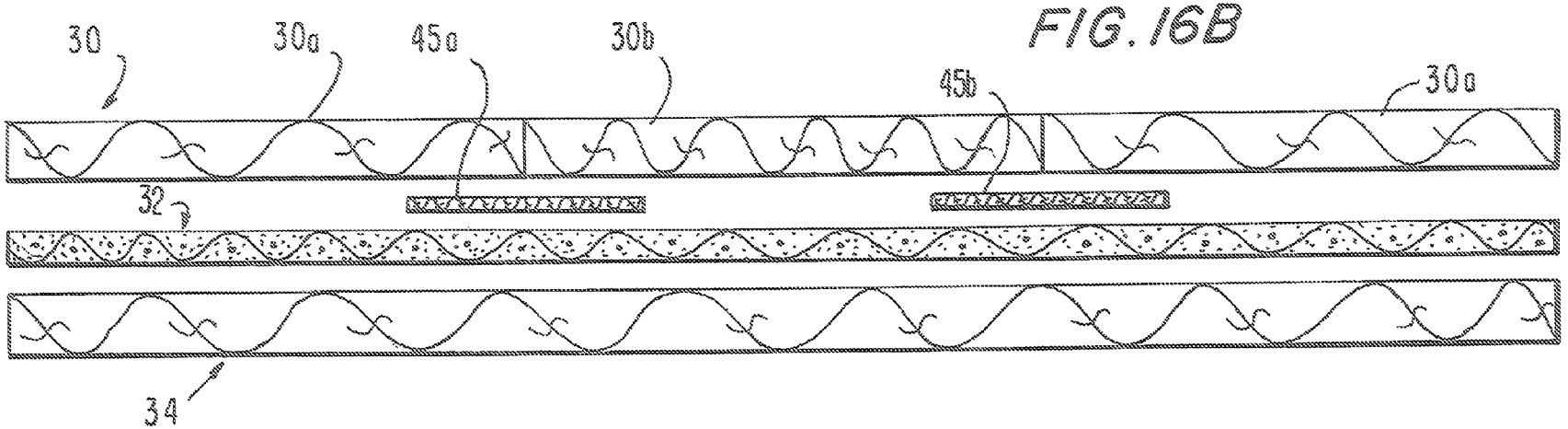
Figure 16C:
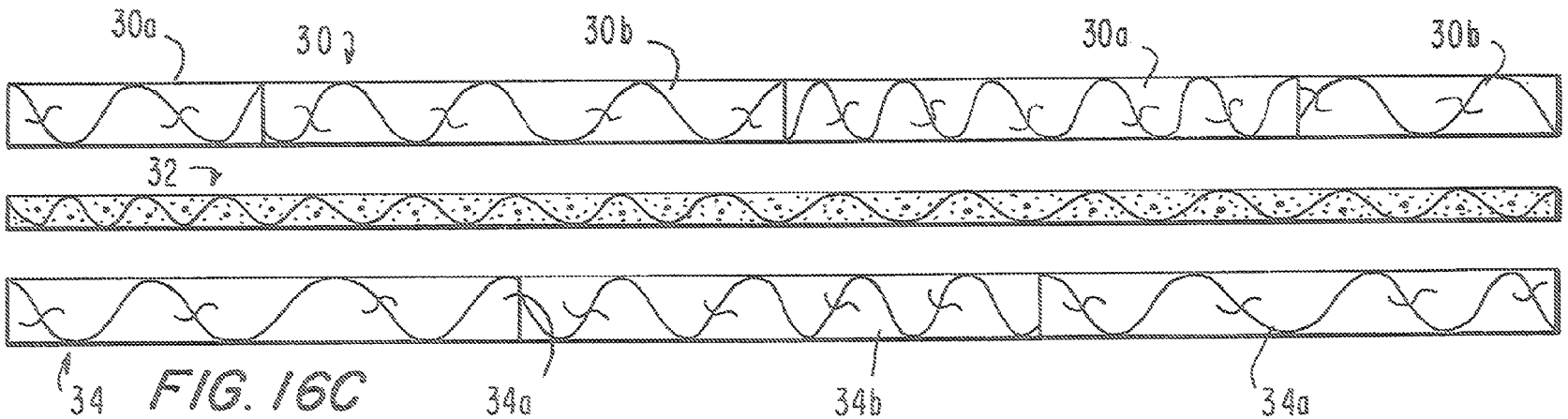
Figure 16D:
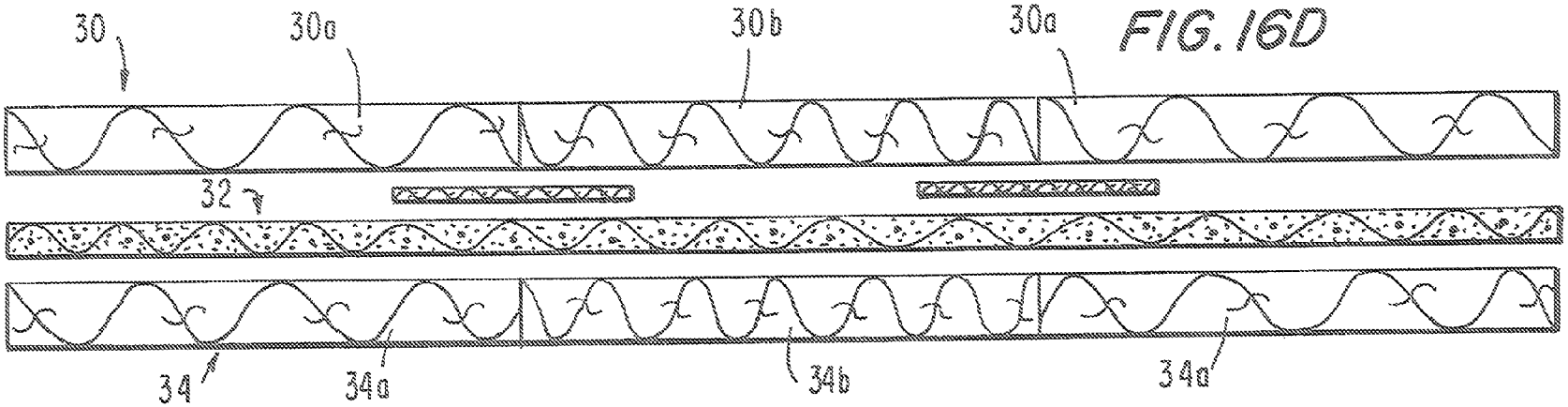
Figure 16E:
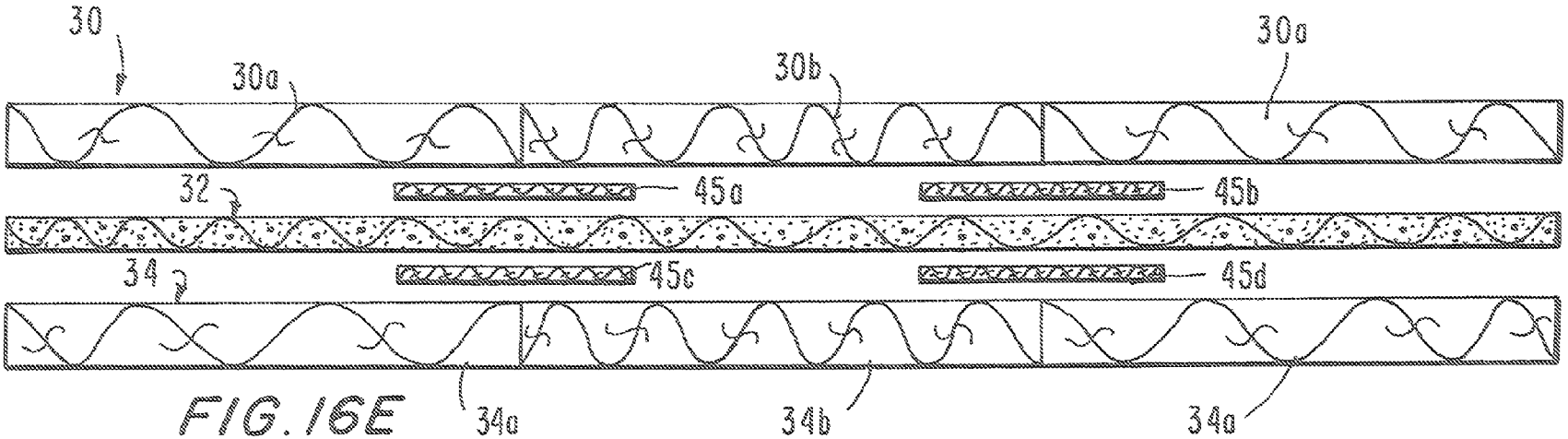
Figure 16F:
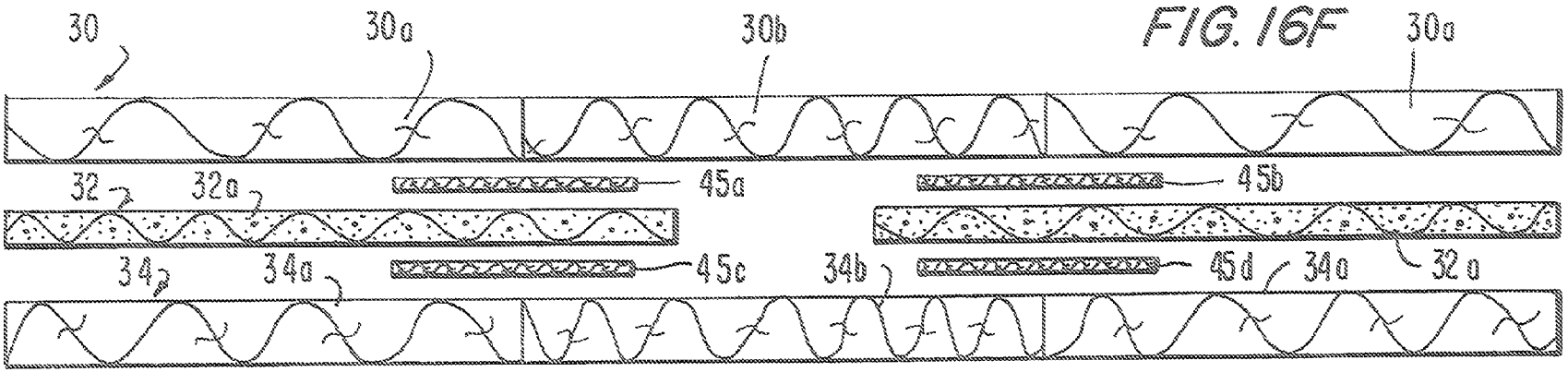

According to still another embodiment of a brassiere made according to the present invention, as illustrated in FIGS. 15 A and B, the brassiere is made as a continuous, closed tubular type garment by joining the open ends of the blank when it is formed, either by sewing, or, preferably, by gluing or fusing the material of the fabric laminate at the ends of the end panels. Such a garment is generally made from a stretch material and is not provided with shoulder straps so that the garment can be worn with certain styles of shoulderless dresses or gowns. This tubular style of garment also dispenses with the need for fasteners or closure devices, since it is put on by the wearer by placing it over their head and pulling the garment down over their chest and breasts. This type of garment is made from a fabric laminate incorporating only fabrics with a high stretch modulus, so that the garment can be stretched when put on and that it will return to substantially its unstretched size when on so that it provides the necessary cling to the wearer so that straps can be dispensed with.

Referring now to FIGS. 7 A and B, a batch type process for the fabrication, assembly, and processing of blanks for brassieres according to the present invention is illustrated for a typical glued brassiere made from a fabric laminate comprising two fabric layers that have been glued together.

Figure 7A:
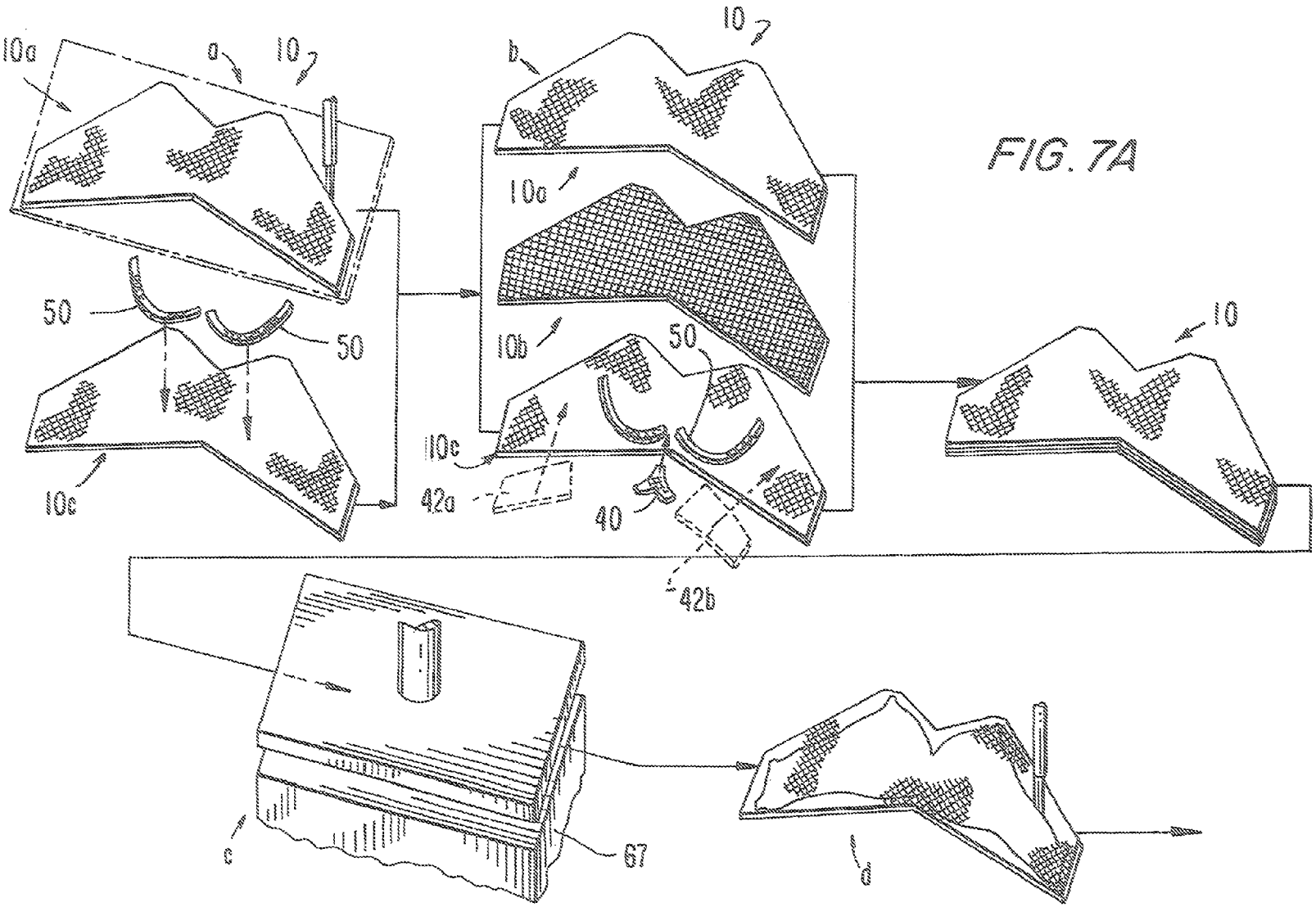
FIGS. 7 A and B are a schematic showing the layout of a batch method for the formation of an individual fabric blank for the manufacture of a brassiere.
Figure 7B:
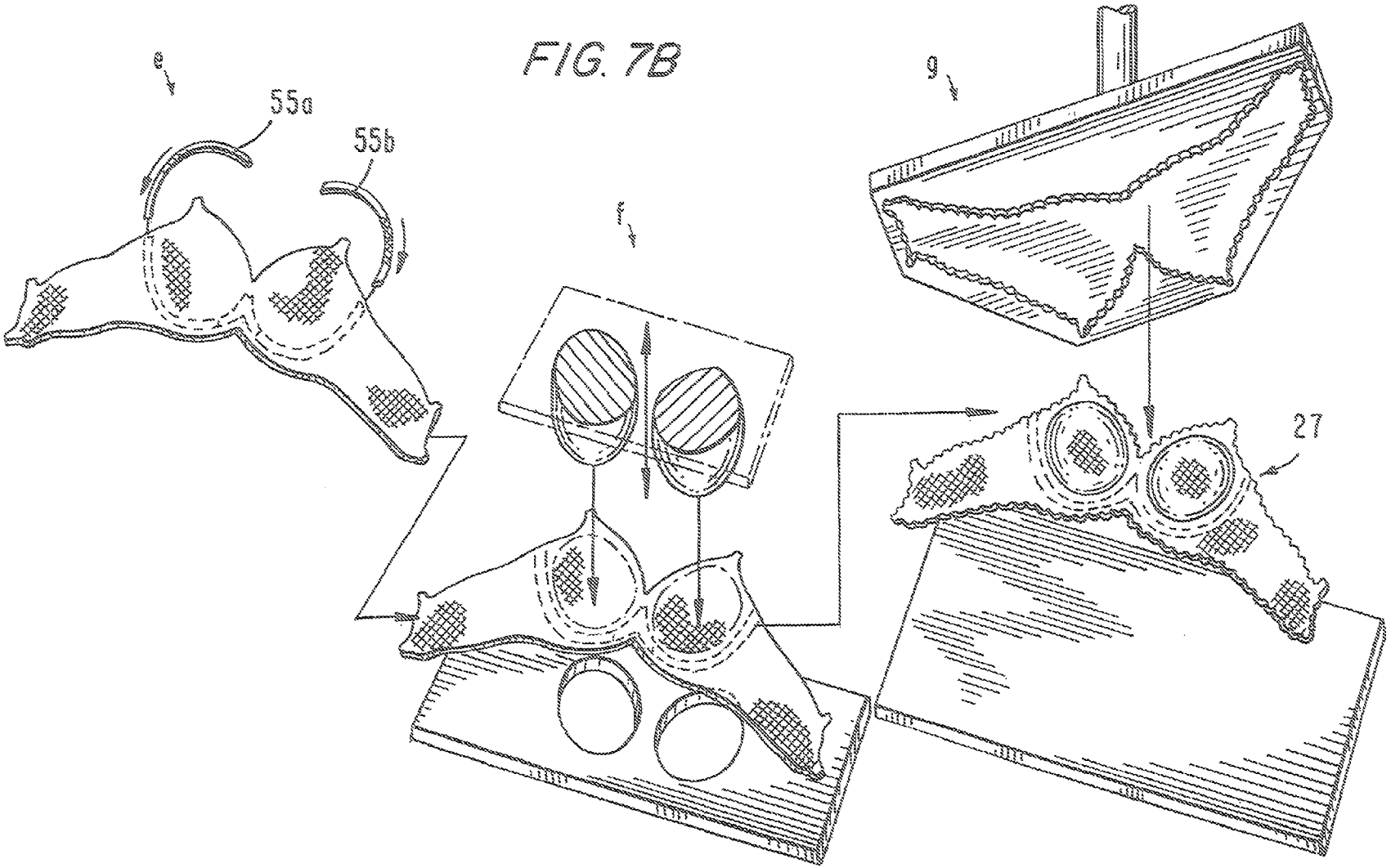

In FIG. 7A, a two-fabric-layer blank 10 for the manufacture of a brassiere in which the two fabric layers 10 *a*, 10 *c* of the blank are adhered to one another over their entire facing surfaces that are in contact with one another in the assembled blank, utilizing an adhesive web blank 10 *b*, is shown as it is first prepared and assembled from its component layers and parts by activating the thermoplastic adhesive material of the adhesive web to glue the two fabric layers together.

Alternatively, a two-fabric layer blank for the manufacture of a brassiere in which the two fabric layers of the blank are adhered to one another over only selected portions of their facing surfaces that are in contact with one another in the assembled blank can be made by utilizing an adhesive web blank 10 *b* in which the thermoplastic, heat-actuated adhesive material has been cut, punched, or otherwise removed from the portions 13 of the adhesive blank in those areas where it is desired to not have the two fabric layers adhere to one another after the blank is assembled and is formed by activating the thermoplastic adhesive material to glue the two fabric layers together. Such an adhesive blank is shown in FIG. 10.

As shown in area a of FIG. 7A, the individual fabric layers of the blank and the adhesive web are first cut from yard goods (rolls, bolts, or sheets) of the respective fabric or fabrics 30, 34 that are to be used for each layer, and, for the adhesive web layer 32, from a roll, bolt, or sheet of the adhesive material. The two fabric layers and the adhesive web layer can be cut individually from separate yard goods of the respective materials. Where the two fabric layers of the garment are to be made of the same fabric, both layers can be cut sequentially from the same yard goods, or the two layers can be cut from two separate sources (e.g., rolls, bolts, or sheets) of the yard goods. Alternatively, where the two fabric layers are the same or are different, the two fabric layers of the blank can be cut by "stacking" yard goods from two sources of the respective fabrics and cutting the two fabric layers of the blanks simultaneously. As a still further alternative, all three layers of the blank, including the two fabric layers, whether of the same or different fabrics, and also the layer of the adhesive web material, can be stacked and cut simultaneously. Cutting of the individual or stacked layers of the blank can be done in any manner, manual (e.g., hand cut using scissors and the like) or mechanized, using mechanical cutting devices and machines. It is preferable to utilize mechanical cutting devices, especially of the type that are computer controlled and which can be programmed to cut to any specified shape and size, in order to ensure consistency and uniformity of the resulting cut layer pieces of the blank.

One preferred way to cut the individual or stacked layer pieces of the blanks is to use a die cutter. In an automated die cutting machine, a die of the desired shape and size is installed, the one or more layers of material to be cut are then positioned between the die and an underlying platen of the machine, and the die is pressed against the platen with the material therebetween to "punch" out the pieces of the blank. Use of such a die cutter is highly desirable because of the uniformity and consistency of the shape and size of the cut pieces.

For a blank of any given size, the three layers 10 *a, b*, and *c*, including the two layers of fabric 10 *a, c* and the layer of adhesive 10 *b*, are cut to have a polygonal shape that generally follows and linearly approximates the outline and two-dimensional, flattened contours of the shape of the final garment that is to be made from the blank, but is, however, composed entirely of linear, straight edged segments. Preferably, a minimal number of straight line segments are used to broadly approximate, outline and define the general shape of the final garment that is to be made from the blank. Furthermore, for a blank for any particular ultimate size of the final garment that is to be made therefrom, the pieces of the blank are cut, either individually or collectively as a stack, such that there is an edge or selvage of from about one-half inch to one inch incorporated in the blank around the entire outer linear edged periphery of the blank, that exceeds the size of the final garment that is to be made from the blank. The general shape and contour of the polygonal shaped main layer pieces of the blank is seen in areas a and b of FIG. 7A and in FIG. 10.

Referring now to area b of FIG. 7A, the next step in the fabrication of the blank is illustrated, wherein the individual pieces of the blank are assembled preparatory to heat treatment in a hot-melt process to form the fabric laminate.

Where the brassiere to be made from the blank is of the underwire type, that is, having channels with shape-defining and support-providing wires inserted therein to give the lower portions of the breast cups of the brassiere some of their shape and definition in addition to that imparted by the molding of the fabric of the breast cups themselves, as well as to provide additional support for the breasts, in contrast to a soft cup type of brassiere that does not have channels with wires therein, and wherein the cup shape and breast support are provided by the molded fabric of the breast cups, often assisted by shaped underbust panels. The next step in assembly of the blank is the application of two fabric channels 50 *a, b* to one of the interior facing surfaces of one of the fabric layers 10 *a, c* for the blanks that have just been cut out in the previous step.

The wire channels 50 *a, b* may alternatively be made from a single long, flat strip of fabric that is attached to one of the fabric layers 10 *a, c* of the fabric laminate before the fabric laminate is heat treated, or may be made from two or more (typically from 2 to 5) layers of strips of fabric that have first been folded-over on themselves to form a tube A channel for a two-fabric-layer channel, or so-called double needle wire channel, is shown in FIG. 4. The channel is attached to one of the fabric layers 10 *a, c* of the fabric laminate before the fabric laminate is heat treated. The strips of channel fabric are typically attached in a curvilinear or substantially "U"-shape, generally following the contour of the underside of the base of the breast cups of the bra, as is shown in FIG. 3. The channels 50 *a, b* are typically made from a material selected from the group consisting of cotton, nylon, polyester, or spandex. The channel material is initially cut in straight strips or pieces. Where the channel material is made from a stretch fabric, the channel material can readily be formed into the desired curvilinear or "U"-shape. Where the material for the channels is not of a stretch fabric, the fabric strips are generally cut on a bias so that the channels made therefrom, either single layer or multi-layer, will have some "give" to them so that they can be shaped into the desired shapes and attached, by sewing or gluing, to a layer of the fabric laminate, without the fabric bunching or binding when shaped. The channels are first attached to a facing surface of one of the fabric layers 10 *a, c*. In a two fabric layer fabric laminate, the channels typically are attached to either the interior facing surface of the layer of the laminate that will become the internal layer of the laminate proximal to and in contact with the garment wearer's skin, or it can be attached to the interior facing surface of the layer of the laminate that will become the external layer of the laminate distal from the garment wearer's skin. Although the channels can also be attached to the external facing surface of either the interior or the exterior fabric layers 10 *a, c* of the fabric laminate, it is generally not desirable to attach the channels to the external facing surface of the interior fabric layer as that tends to cause discomfort to the garment wearer if the channel is in direct contact with the wearer's skin and it is generally not desirable to attach the channels to the external facing surface of the exterior fabric layer as that tends to be generally not aesthetically acceptable because that tends to create a visible bulge on the surface of the garment facing outwardly away from the wearer, which can detract from the smooth, even lines and contours of the exterior of the garment, and which can often be seen through the wearer's outer clothing; and/or which may detract from the lines of a printed or embossed design or pattern on the external facing surface of the exterior layer of the laminate of the garment. It is preferable, therefore, to attach the channels to an interior-facing surface of one of the fabric layers 10 *a, c* of the laminate. In a two fabric layer laminate, it is still more preferable to attach the channels to the interior facing surface of the interior fabric layer closest to the garment wearer's skin, since when placed there, the underwire tends to provide the most support.

The channels are typically stitched to the inner-facing surface of the interior fabric layer of a two-fabric laminate. Alternatively, they can be glued or fused to the fabric. The channels are typically installed such that a distal end of the channel, towards the center or interior of the garment is closed off by the same method as which the channel itself is attached to the fabric, i.e., by stitching, gluing, or fusing, leaving an open, proximal end of the channel proximate to and abutting an exterior edge of the blank in order for an underwire 55 *a, b* to be inserted into each channel and then sealed therein at a later stage in the assembly of the garment, after the fabric laminate has itself been heat treated to adhere the several layers together.

Alternatively, if it is not desired that the channels 50 *a, b* should extend all the way to a periphery of the blank and an opening be left therein so that the underwires 55 *a, b* can be inserted later, the underwires 55 *a, b* can be inserted into the channels 50 *a, b* immediately after the channels 50 *a, b* have been attached, and then stitched, glued, fused, or otherwise closed at the other end of the channel, to seal the underwires 55 *a, b* therein, prior to heat treatment of the blanks to seal the several layers together.

In a three or more fabric layer fabric laminate, the channels can be attached to any of the internal facing surfaces of either outer fabric layer, or to either facing surface of any internal fabric layer of the laminate. By attaching the channels to the same facing surface of the same fabric layer as for the two fabric layer laminate, or to the first interior facing surface of the fabric layer closest to the innermost or interior fabric layer nearest to the garment wearer's skin, the channels with their inserted underwires will tend to provide the most support.

Some preferred fabrics for the channels include brushed nylon and nylon taffeta. Still referring to area b of FIG. 7 A, the next step in the preparation of a blank for a brassiere involves assembly of the parts of the blank prior to heat treatment to activate the adhesive of the adhesive web in a hot-melt process, in order to glue all of the component parts of the fabric laminate together.

Figure 6:
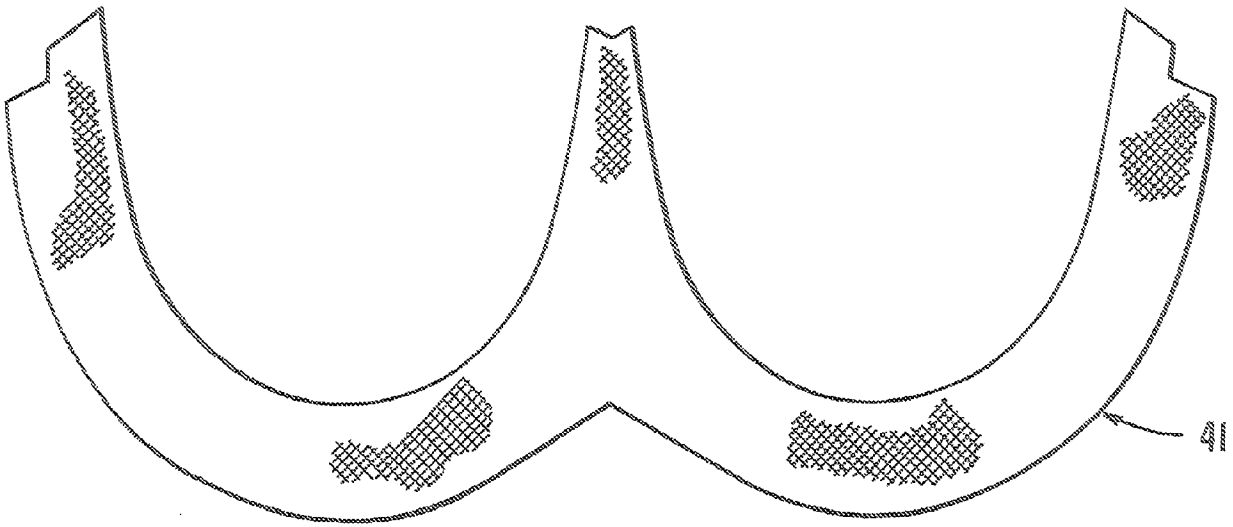
FIG. 6 is an elevational view of a one-piece full supplemental front support insert for a brassiere, which includes a central gore and undercup support panels that can be incorporated into a brassiere blank of the present invention.

Just prior to such assembly, however, if the brassiere is to include any other stabilizing inserts, they are first cut from whatever material they are to be made from. Typically, all rear- or back-closure brassieres, both of the underwire and the softcup types, will include a central reinforcement piece, usually referred to as a gore 40, which is positioned between the two cups 57 *a, b*. The gore 40 is a generally triangular shaped piece of material that provides additional separation between the two cups and stability to the garment in the central region. A typical gore 40 is shown illustrated in FIG. 5. Alternatively, a more extensive central reinforcing piece 41, that includes integrally formed underbust support panels that are substantially "U"-shaped and which substantially follow the shape and contour of underwire channels 50 *a, b*, as is shown in FIG. 6, may be inserted between the layers of fabric 10 *a, c* and the adhesive web layer 10 *b* prior to heat treatment to form the fabric laminate. The extended gore 41 with underbust support panels can be used either in an underwire type brassiere to provide additional stability, form, and support to the channels 50 *a, b* and underwires 55 *a, b*, or it can be used in a soft cup type brassiere to provide basic stability, shape, and support in place of the channels 50 *a, b* and underwires 55 *a, b*. Where a brassiere includes both a gore 40 or an extended gore 41 and channels 50 *a, b* with underwires 55 *a, b*, the gore 40 or extended gore 41 can overlap at least a portion of both of the channels 50 *a, b*, when it is placed in position as the blank is assembled. Typically, both a triangular shaped gore 40 and an extended gore 41 are made from a material that does not have, or only has limited elastomeric properties, and is usually selected from the group consisting of cotton, polyester and nylon. When the blank is being assembled, a gore may be inserted between either of the fabric layers 10 *a, c* and the adhesive web layer 10 *b* in a two-fabric layer laminate; between either exterior fabric layer and its corresponding adhesive web layer or between either facing surface of the interior fabric layer and its respective corresponding adhesive web layer in a three-layer fabric laminate (not shown); or between any interior facing surface of any exterior fabric layer and its corresponding adhesive web layer or between any interior facing surface of any interior fabric layer and its corresponding adhesive web layer for a four or more fabric ply fabric laminate.

Gores 40 and extended gores are typically made from a polyester knit material, preferably a circular polyester knit.

In addition to a triangular or an extended central gore for a back-closure type bra, further inserts 42 *a, b* (shown in dashed lines only in FIG. 7*b*), made of the same material as the gore (e.g., a polyester knit, especially a circular polyester knit), or of a material having elastomeric properties to stretch along with the fabric of the side and end panels where they are themselves made from an elastomeric material (e.g., spandex), can be inserted in the side and end panels of any type of bra, front or back closure or tubular, and underwire or softcup, to provide additional stability and support to the side and end panels. These additional inserts or panels are optional. Such panels are typically rectangular, oblong, or are elongated with curvilinear shaped ends and or portions.

Assembly of the layers and pieces of the blank can also be done as a manual operation, or assembly on a batch basis can be automated, with machines laying the layers down in sequence and placing the inserted pieces in position as required. Where such a batch blank assembly procedure is automated, it is preferable to use computer control and—a line-up and tracking procedure for the blanks to ensure that the layers and pieces are assembled within a predetermined tolerance. For example, an optical scanning system can be incorporated to help in doing this. In such a system, each layer or piece of the blank to be assembled has some indicia present thereon to enable an optical scanning device to determine that the layers and pieces have been positioned properly with respect to one another. Such indicia may be permanent or may be temporary. It is preferable that any such indicia printed on any of the layers or parts be placed where they will not be visible in a finished garment. Where it may be unavoidable that such indicia can be seen, they can be printed with temporary inks that will evaporate from the surface before the final garment is finished from the blank.

When the blank is fully assembled, with all of the layers and pieces, in position, it is ready for heat treatment, using a hot-melt process. As is shown in area c of FIG. 7 A, the assembled blanks are sent to a heat treatment step wherein the thermoplastic adhesive web is thermally actuated in a hot-melt process to cause all layers and parts of the assembled blank that are in contact with the adhesive material of the web to become glued together when the adhesive web melts and the adhesive is actuated or made tacky.

The hot-melt process of the heat treatment step is preferably a two step process that includes both a high temperature step, followed by a low temperature step.

In the high temperature step, the assembled blank is exposed to heat that raises the temperature of the blank to at or just above the melting point temperature of the adhesive in the adhesive web, causing the web to melt and the adhesive to flow into the pores or interstices of the fabric layers and/or over those portions of the fabric itself, which have been exposed to and are in contact with the adhesive. By controlling the nature and flow properties of the adhesive used, as well as the temperature of the heat treatment process steps themselves, the adhesive can be controlled so that only those portions of the fabric laminate and any inserted pieces in the blank that are desired to be glued together are in fact glued together, and those portions that are not to be glued, if any, in a blank for a given garment wherein it is desired that not all portions of the blank are to be glued together (e.g., in a brassiere where it is not desired to have the fabric layers in the regions that are to become the cups of the finished brassiere become glued together), are left glue-free during and after heat treatment. Typically, the temperature of the first, hot stage of the hot-melt process is maintained at from about 100° C. to about 200° C. This is sufficient to bring the adhesive used in the web to or slightly above its melt temperature, while still being well below a temperature that would damage or otherwise affect the physical properties and characteristics of any of the fabrics that are used in the multi-layer fabric laminate. A sufficient pressure is applied to the blank during this heating stage to cause the molten adhesive to flow into the interstices of the fabric layer or otherwise overspread the areas in which it is desired for adhesive to adhere, without being too high so as to cause "bleeding" of the molten adhesive through any of the fabric layers, which would damage the external facing surfaces of the fabrics. The residence or dwell time of the blank in the hot stage of the hot-melt process is dependent on the nature and properties of the adhesive, including its melt temperature and its viscosity and flow characteristics when in the molten stage, as well as the characteristics and properties of the fabric layers being used in the laminate, and the actual temperature at which the hot zone of the hot-melt process is maintained. A typical dwell time is on the order of from about 10 seconds to about 90 seconds.

The hot stage of the hot-melt process is immediately followed by a cold stage of the hot melt process, wherein the temperature of the fabric laminate is rapidly lowered so as to cause the molten adhesive to re-solidify and bond the various layers and pieces of the fabric laminate together. As the molten adhesive cools and solidifies, it forms both chemical and physical bonds with the fabric material and with the material of the other inserted pieces in the laminate. Typically, the temperature of the cold stage of the hot-melt process is in the range of from about 50° C. to about 150° C. The cold stage is also performed under pressure to maintain good contact between all of the glued layers and inserted pieces of the laminate as the adhesive sets in order to form a strongly bonded laminate with no gaps or entrapped air bubbles between any of the layers that would destroy the integrity and aesthetic appearance of the fabric laminate. The residence or dwell time of the fabric laminate in the cold stage of the hot-melt process is typically of the same order of magnitude as in the hot stage, with a minimum of about 10 seconds and a maximum of about 90 seconds.

The exact combination of values of temperature, pressure, and dwell time parameters to be used for the overall hot-melt process and for the individual hot and cold stages thereof can readily be determined and optimized by persons of ordinary skill in the art of hot-melt processes, knowing the particular fabrics and adhesive being used in any given situation.

Even though the heat treatment process, as described here, is performed as part of a blank assembly and manufacturing process conducted generally on an individual blank basis (although generally referred to as a "batch" basis), the equipment therefor is usually capable of handling a plurality of blanks simultaneously, on basis that is actually more of a semi-batch (or semi-continuous) basis. Accordingly, typically, from about six to about twelve blanks (not individually shown) are heat-treated together.

After lamination, the glued fabric laminate blank from heat treatment is ready to be cut to produce the basic garment that is to be made therefrom, as is shown in area d of FIG. 7A. A basic garment cut from a blank is a precursor of the final garment and has the essential size and shape of the finished garment, but does not include the various finishing accessories, which in the case of a brassiere include, for example, the closure means for either a front or back closing garment, and/or the shoulder straps for a brassiere of that type. Because garments made according to the present invention are cut from blanks of the fabric laminate, each has an edge that is fully glued, and thus no edge finishing step is required for garments cut from the blanks in order to prevent the edges from unraveling. Accordingly, garments made according to the present invention can be cut to have substantially linear lines over most of the garment, with simple straight edges, as is seen in area d of FIG. 7 A.

For underwire type bras, in which the underwires have not previously been inserted and sealed within the channels, the underwires 55 *a, b* are then inserted into the channels and the open ends of the channels are closed by stitching, gluing or fusing, as shown in area e of FIG. 7 B. The underwires can be made of a metal or plastic material. A typical, preferred metal is stainless steel. Metal underwires can also be made from aluminum. Plastic underwires are typically made from rigid or semi-rigid plastic materials. Either metal or plastic underwires may also be provided with soft plastic cushioning tips, typically made from vinyl.

In the manufacture of brassieres from fabric laminate blanks according to the present invention, the next step in the process involves molding of the breast cups. The cut blank from the previous step is next sent to a cup-molding station or machine wherein the cups are molded to give them a permanent fixed shape, as shown in area f of FIG. 7 B. The cup-molding step is substantially identical whether the fabric in the cup regions of the blank are glued or unglued.

A variety of machines can be used to mold the cups, as will be known to persons of ordinary skill in the art, with the two cups alternatively being formed either separately, or together. According to one such method and machine therefor, the blank is folded symmetrically in half with the material in the region of the two cups superimposed over each other. The garment is then placed in the machine with the overlapping material of the cup regions being positioned over a cavity. A mold, having a first circular cylindrical shaped portion with a paraboloid shaped portion at one end thereof, such that the mold has a substantially shell or bullet-like overall shape and appearance, and often referred to as a "bullet" mold, is positioned over the cavity, which is a three-dimensional, concave well having a shape configured to receive the bullet mold. Both the bullet mold and its cooperating receiving cavity have a circular diameter and a depth corresponding to the dimensions of the cup size that is to be made. Accordingly, a different size and shape bullet mold and its associated cavity are used for every cup size to be made. Typically, the bullet molds and cavities on the machine are readily interchangeable, so that a bullet molding machine can easily be reconfigured to mold different size cups on either the same or different size garments during the course of a production run.

The bullet mold is lowered into the cup material, which spans the cavity, to stretch it and press it into the cavity to a predetermined depth to impart the desired shape to the cups. The cup-molding process is performed at an elevated temperature. Accordingly, at least one of the bullet mold and the cavity, typically at least the bullet mold, and often both the bullet mold and the cavity are first heated to a temperature sufficient to cause a permanent change in the characteristics of the cup material, as the bullet mold is pressed into the cup material, without the temperature to which the cup material is heated being so high as to cause scorching or other heat damage to the fabric. The heat from the bullet mold and/or cavity causes a change in the shape memory retention properties of the cup fabric. The bullet mold is then withdrawn from the cavity, leaving the molded cups on the blank. The shape memory of the cup size that is imparted into the cup material by this process will last despite laundering and ironing of the garment.

In an alternative method, such as is particularly illustrated in area f of FIG. 7 B, using a different machine, the cups of a brassiere are molded 'individually yet simultaneously, using a dual bullet molding machine, wherein two identical bullet molds for the desired size and shape cup are positioned adjacently side-by-side to one another. The blank is positioned in a fully laid-open manner over a pair of side-by-side adjacent cooperating cavities or wells, that have a concave shape and are sized to cooperate with one of the respective bullet molds, as in the single bullet molding machine described above, and the two cups are simultaneously formed adjacent to one another in substantially the same manner as described above for the single bullet machine. Both bullet molds and/or both cavities of a dual bullet molding machine can be heated. Both bullet molds and their respectively associated cavities are interchangeable on the dual bullet molding machine so that the size and/or shape of the cups being molded can easily be changed during a production run. The heated dual bullet dies are pressed into the cup fabric to a predetermined distance to heat the cup material and form the shaped cups. The permanent shape molding of the cup shape into the fabric of the cups also occurs by the same thermally induced shape memory process as previously described. After the cups have been molded, the brassiere blank is substantially finished and is ready for final assembly of the garment.

Just prior to final assembly, including the installation of closure devices or closure into a three-dimensional garment in the case of a tubular style brassiere, and/or the installation of straps as necessary, depending on the style of brassiere being made, and while the garment cut from the blank is still, except for the molded cups in the cup region, essentially a two-dimensional blank, any desired decorative edge finishing may optionally next be applied. As has been previously stated, although bras made according to the present invention have edges that are fully finished when the garment is cut from the blank with substantially straight-cut, linear edges, which edges, because they are glued together, resist unraveling and do not require that the edges be stitched, or the application of any type of edge binding material, it may nevertheless be desired to provide a decoratively shaped peripheral edge to the garment cut from a blank. Such an edge may include, for example, but is not limited to the provision of a scalloped edge around all or part of the peripheral edge or outer perimeter of the garment. Such a decorative edge can be provided by cutting the desired shape into the fabric laminate at the edge of the garment, around the outer edge of all or part of the garment, as is desired. It is preferable to utilize a mechanical cutting device, which is also preferably computer controlled and guided, such as by being indexed or programmed to follow a predetermined outline of a blank for the desired size, shape and style garment, in order to ensure symmetry and uniformity of the resulting pattern-cut blank. Such a linear cutting process, however, is very time consuming, or has a high dwell time in the cutting machine. It is desirable to reduce the cutting time as much as possible. One way to accomplish this is to die-cut the edge design or pattern in a single step punching operation, as is particularly shown in area g of FIG. 7 B.

Accordingly, it is still more preferable, however, in order to save cutting time and to further assure symmetry, uniformity, and consistency in the cut edge design, from garment to garment, that the decorative outer edge pattern or design be cut in a single step operation using a die cutting machine, as is shown in area g of FIG. 7 B. A die is first prepared for each size garment, with the desired edge pattern, scalloped or other, permanently cut into the die for that garment. The straight-edge cut garment is then carefully positioned over a platen of the machine and the die is forcibly pressed or stamped down on the garment, to effectively punch it out as a finished piece with the desired shaped edge neatly, precisely, uniformly, and consistently cut into the edge at whatever portions of, or on the entire periphery of, the edge that the pattern was present on the die.

As will be appreciated by persons skilled in the art, the order of certain of the above manufacturing steps can be changed without affecting the results. Specifically, the steps following the hot-melt process for forming the fabric laminate, including cutting the selvage from the blank to the actual garment shape; breast cup molding; underwire insertion and channel closure (where applicable, i.e., for underwire type brassieres); and final decorative edge cutting (if desired), can be rearranged, so that, for example, the breast cups are molded before the garment is cut out from the blank (i.e., selvage area removed). With regard to FIGS. 7 A and B, this would be reflected by performing the steps of areas e and f of FIG. 7 B before the step of area d of FIG. 7 A.

After the edge-cutting step has been performed, the garment is ready. Indeed, for certain styles, almost no additional processing steps are required. The simplest style, namely, a tubular strapless style, requires only the joining and closure of the back panels in order to be completed. This can be done by stitching, gluing, or fusing the juxtaposed ends of the two back panels together.

Other styles of bras, namely, both front and back closure types, as well as those with straps, are also now ready for installation of such closure devices and/or straps, as desired for the particular type of brassiere being made.

Figure 12A:
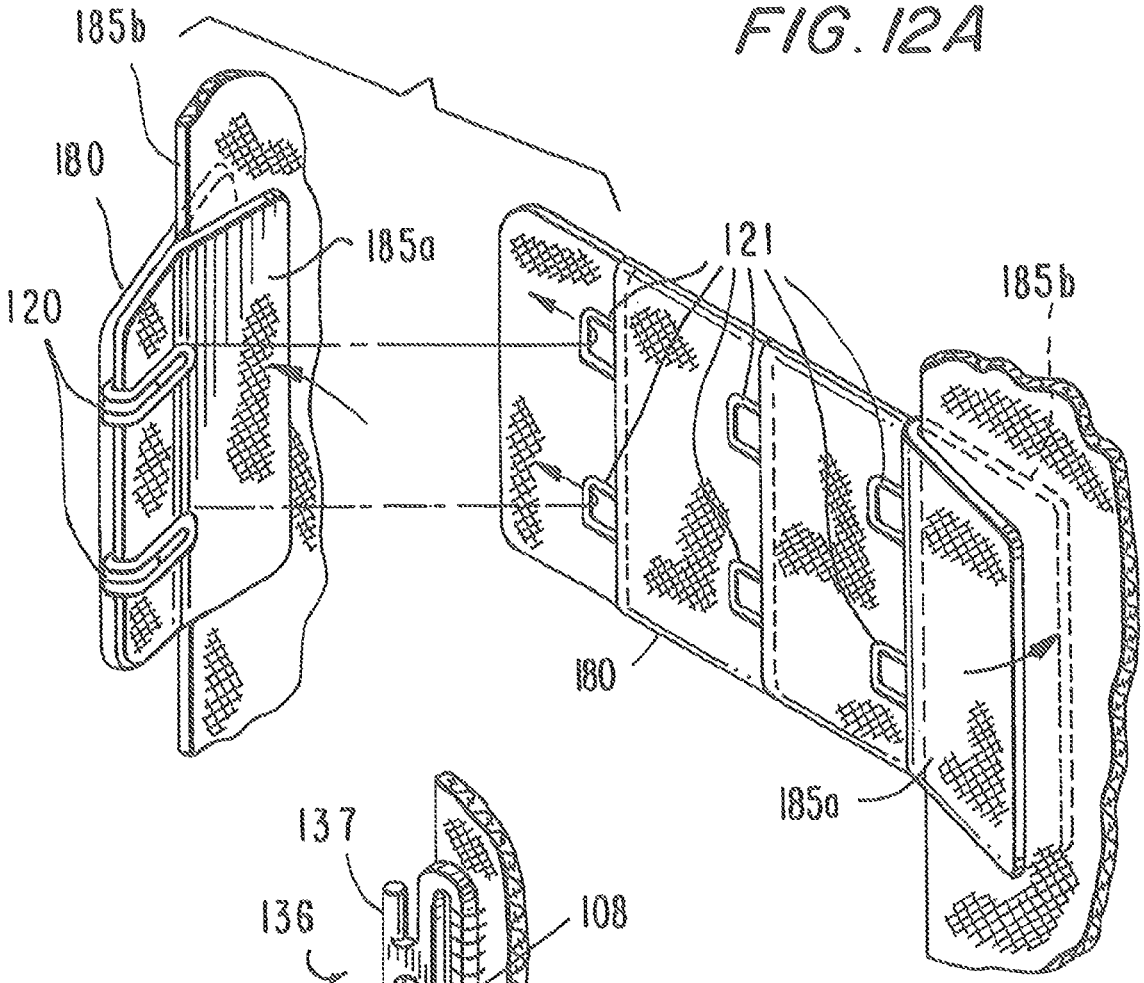
FIGS. 12 A, B, and C are perspective views of back closure devices utilized with brassieres made according to the present invention.

For back closure style bras, typical closure devices used include a plurality of devices selected from the group consisting of "hook and eye" fasteners, as are illustrated in FIG. 12 *a*; snaps, as are illustrated in FIGS. 12 B and C; and a Velcro® type fabric closure device, also known as a "hook-tape" closure device.

As used herein, the term "paired assembly" as used in reference to a closure device, means the two cooperating members or elements of any given type of closure device. Thus, for a hook and eye closure device, as paired assembly includes one hook and one eye; for a snap type closure device, a paired assembly includes one male and one female element; and for a Velcro® or hook-tape type closure device, a paired assembly includes one strip of material bearing a plurality of micro-sized "hook" elements and another strip of fabric bearing a mass of a dense, filamentous material with which the hooks are capable of securely engaging. Usually from two to four complete paired assemblies of hooks and eyes or snaps are used for a single garment. Velcro® or hook-tape closures are usually provided as a single continuous strip of each cooperating piece of the paired assembly, such that the fabric backing strips are cut to the desired length, although several smaller individual sections, wherein each smaller section is a paired assembly, can alternatively be used. Certain factors, such as the width of the end panels for a given style brassiere, can affect the decision as to how many paired closure assemblies to use. For example, on a garment with narrower end panels, it may be possible to incorporate only two assemblies, while on a style with broader end panels designed to provide greater back support, it may be possible to fit as many as four or five paired closure assemblies. The hook and eye or snap closure devices are generally installed in a linear vertical pattern, with all of the hooks 120 or male portions 125 of the snaps, respectively, being at the end of one end panel, and all of the eyes 121 or female portions 126 of the snaps on the end of the opposite end panel. The hooks and eyes and snaps can be installed on the garment in a number of ways, with stitching being the most common. For the snap type closure devices, each piece can alternatively be anchored to its respective end panel using a grommet-anchoring piece 127, such as is illustrated in FIG. 12B. It is also possible to glue or fuse the individual elements of each pair to its respective end panel. A Velcro® type closure device, consisting of a pair of cooperating pieces or strips of material, with one piece being a backing strip of material having a plurality of hundreds of tiny hooks per square inch attached thereto, and the other piece being a backing strip of material having a volume of fuzzy, wool-like material adhered thereto for cooperation and engagement with the plurality of hooks on the opposite end.

Although each hook and eye piece of each paired assembly and each of the male and female parts of a snap closure device can be installed individually and separately on a respective end of the garment, it is preferable to first attach the desired multiples of paired assemblies to strips of fabric 180, which are then secured to the respective ends of the end panels of the garment. The individual hook and eye pieces can be attached to such fabric strips by stitching or gluing them thereto. The individual pieces of a snap closure can similarly be attached to fabric strips, or, alternatively, they may be attached to a fabric strip using grommets. The fabric strips are typically made from two plies of fabric with the respective fastener pieces being sandwiched therebetween both to provide a more secure way of anchoring them to the strips and to prevent the backs of the pieces from protruding in a way that may cause discomfort. Only the front of each piece of a fastener extends from a front face of the fabric strip so that it can cooperatively engage its corresponding part. One edge of each fabric strip, namely, the edge that is proximate to the edge of the end panel of the garment to which it is secured, can be split into two flaps 185 *a, b*, as is shown in FIGS. 12 A and C, in a so-called "lip-fold", so that the strip can be more securely attached to the respective end of the garment by surroundingly attaching the two flaps or lips to the end of the garment, such that one flap or lip is on either side of the end panel. The strips of a Velcro® type closure device can be similarly made to have a dual flap or lip-fold at one end of each piece to envelop the edge of the garment. The fabric strips bearing the multiple parts of the respective closure devices or Velcro® are permanently affixed to the end of the garment by stitching, gluing, or fusing the fabric to the fabric laminate of the end of the garment. However any such closure device is attached to the garment, it is desirable that it be capable of resisting at least 30 pounds of tensile stress to avoid being torn from the garment due to stress and strain while in a closed state when the garment is being worn.

In order to provide some adjustability to the size of the garment, there is generally provided a redundant plurality of one of the ends of the respective closure devices at various positions longitudinally along the length of the rear of one end panel of the garment, to account for the fact that individuals of the same nominal size may be shaped differently, and because any one individual's size may vary over time or seasonally due to weight changes or fluid retention, to enable the wearer to select the closure position that provides the best custom fit for that individual at any given time without having to purchase and maintain a variety of garments of different sizes, and trying on various ones each time, in order to achieve the best possible and most comfortable fit. In the case of hook and eye type fasteners, typically a redundant plurality of the eye pieces are provided at various longitudinal positions along the length of the back of the garment, with, as is shown in FIG. 12 A; all of the eye pieces being mounted to a single strip of fabric which is attached to the end of the end panel of the garment; for snap type fasteners, typically a redundancy of the female pieces is provided (not shown); and for a Velcro® type closure device, it is typically a plurality of sections of the fuzzy, hook-catching end that is provided, either as separate sections or a one continuous panel encompassing the width of the adjustable portion along the length of the end panel (not shown).

Although any of the foregoing types of closure devices, including plural pairs of cooperating hooks and eyes, male and female snap parts, and Velcro® or hook-tape strips, can also be utilized as closure devices for front closure type brassieres, often, different closure devices specifically made for front-closure type bras are used.

Figure 13A:
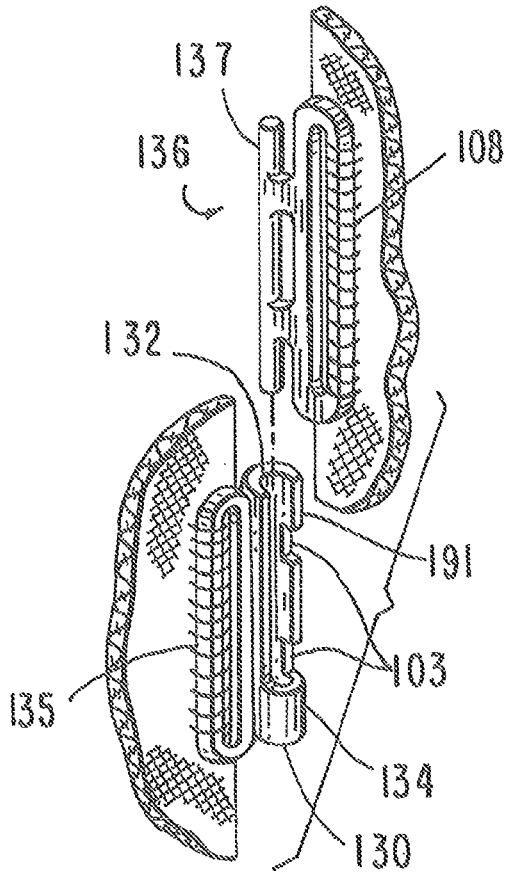
FIGS. 13 A and B are perspective views of front closure devices utilized with brassieres made according to the present invention.

One such closure device developed specifically for front-closure style bras is the slide, twist and snap barrel catch as is shown in FIG. 13 A. One piece 130 of the device contains a chute or channel 131 that is typically substantially circular cylindrically shaped, with one open end 132 and with partial gaps or openings 133 in a front face portion of the wall of the channel 134, and with portions of the wall of the channel biased slightly inward toward the channel to provide locking tension against a post member mounted on a cooperating, opposite piece of the closure device that is subsequently inserted into the channel to effect closure of the garment. Attached to a side of the channel-containing piece 130 of the closure device, at a side thereof that is to be adjacent to its respective open end of the garment to which it is to be attached, is a ring or other means 135 by which the end of that piece of the device can be attached to the edge of one open front end piece of the bra, in the region between the cups. The cooperating opposite piece 136 of this closure device includes a post or rail 137 that is substantially circularly cylindrical shaped to cooperate with the chute or channel 131 of the opposite piece. Attached to a side of the post-bearing piece 136 of the closure device, at a side thereof that is to be adjacent to its respective open end of the garment to which it is to be attached, is a ring or other means 138 by which the end of that piece of the device can be attached to the edge of the open front end piece of the brassiere on the side opposite to that to which the channel portion of the closure device is attached, in the region between the cups. Although the parts of a barrel type front closure device can be installed to the respective sides of the front sections of the brassiere in any manner, it has been found that installing them such that the open end of the channel piece faces upward facilitates opening and closing the device.

According to one preferred method of installation of a barrel type front closure device, the respective pieces of a barrel type closure device are typically attached to respective front ends of the brassiere so that the piece of the closure device bearing the channel is positioned such that the open end of the channel faces upward, so that the wearer can see the open top end of the channel and easily slide the cooperating post on the opposite side of the brassiere down into the channel. According to one embodiment, the piece of the barrel closure device with the channel is attached to the left front side end of the brassiere (right side, as viewed from the front), with the open end of the channel at the top, and the piece of the closure device with the cooperating post is attached on the right front side end of the brassiere (left side, as viewed from the front). To effect closure of the garment, the wearer, after putting on the bra, first grasps the end of the garment bearing the post and vertically slides the post downwardly into the channel at an angle up to approximately a right angle with the front of the channel to bring the two ends of the barrel closure device and the brassiere together; rotates the post and that end of the brassiere so that the post rotates in the channel until the two ends of the brassiere are in substantially the same plane, i.e., at about a 180° angle with respect to one another; and then snaps or clicks the post-bearing piece of the closure device into the channel-bearing piece to lock the two ends together.

To open the device in order to remove the garment, the post end 136 is first unsnapped or unclicked to release it from its locked position in the channel 131, the post 137, together with the end of the garment to which it is attached is then rotated to approximately a right angle with the opposite end of the garment with the channel piece 130 and the post piece 136 and its end of the garment is then vertically slid upward and out of the channel.

Figure 14:
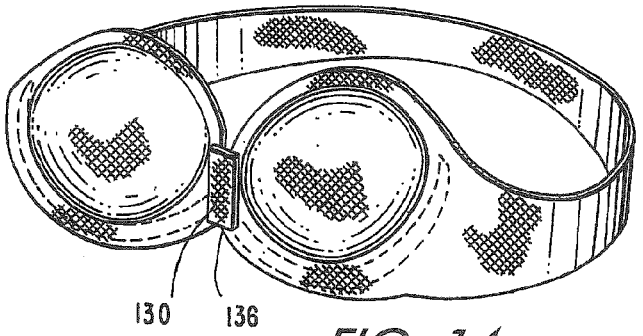
FIG. 14 is a perspective view of a finished front-closing brassiere in accordance with the present invention.

A complete and fully assembled brassiere of the front-closure style, with shoulder straps, and having a barrel type front closure device, is illustrated in FIG. 14.

A variation of the above-described post and channel "barrel" type front closure device, wherein the two parts cooperate in substantially the same manner as described above for the barrel type front closure device, but wherein the cooperating channel and post pieces are of an essentially flat, rather than cylindrical shape, is shown in FIG. 13 B. The parts of a flat front closure device, having numbers corresponding to those of the barrel type front closure device, but different by 10 (e.g., 140=130, 141=142, etc.) have identical or substantially similar and equivalent functions as described above for the numbered parts of the barrel type front closure device.

Both the barrel type and the flat type of front closure devices are typically made from plastic. Generally, a hard, rigid or semi-rigid plastic, such as a polystyrene is used for the elements of these type closures. The plastic should also have sufficient resiliency to enable it to flex or give as the two cooperating parts are snapped together and be sufficiently strong to resist cracking or breaking, even after repeated cycles of opening and closing of the device.

Generally, because the front closure devices are slightly bulkier than the previously described types of closure devices used for back-closing brassieres, because there is generally less space in the inter-cup region of the front of the brassiere than along the end panels at the back of the brassiere, and because it would be more uncomfortable to have additional closure elements attached at the front of the bra, where they might press or pinch the softer, more tender breast tissue, front-closing bras typically have only a single closing device and thus have a slight disadvantage in not having as much size adjustability as a back-closing bra. Front-closing brassieres, however, are often much more practical for handicapped individuals, such as women with disability to their upper arms and/or hands, due to injury or diseases, such as arthritis, that may make it difficult or impossible for them to reach around their back to fasten the garment. Front closing brassieres with barrel catch type front closure devices, moreover, may be simpler and easier to fasten for women whose manual dexterity may be compromised.

It may also be desired to manufacture a single main piece undergarment that is fabricated from a composite fabric laminate wherein not only different layers of fabric that comprise the laminate may be made of different fabrics, as disclosed and discussed for the preceding embodiments of the invention, but wherein even different surfaces or areas of the garment, laterally adjacent to one another along the surface of the garment, are made of different fabrics. Different layers of the fabric laminate, transverse to one another, may also be made of the same or different fabrics, as in the above previously described embodiments. As used herein, the term "composite fabric laminate" refers to a fabric laminate wherein abutting sections of a single fabric layer are composed of different fabrics, which may be the same or different from one layer to another. This is to distinguish a "composite" fabric laminate from a "simple" fabric laminate or just fabric laminate wherein any given layer of the laminate is made from only a single fabric, and the fabric may differ only from one entire layer to another and not within a single given layer.

For example, it may be desired to fabricate a brassiere wherein an entire first layer of a two-fabric layer fabric laminate that will become the inner surface on the interior of the finished garment facing the wearer's skin, is made of cotton for comfort reasons, while it may be desired that the second layer of the fabric laminate that will become the outer surface on the exterior of the garment facing outwardly away from the wearer, be made of a cotton polyester in the region of the cups, so as to provide some stretch and control without becoming too tight on the sensitive, softer tissue in the breast region, and of a spandex around the remainder of the garment, including the sides and back portions, so as to provide maximum control in those areas where firmer support will not be unduly comfortable. Previously, the fabrication of such types of composite material garments was difficult and the results were often unacceptable from both the manufacturer's perspective as well as the wearer's perspective. Previous composite fabric garments were onerous to manufacture and required the fabrication of separate, modular sections of the garment, where each section generally could be made from only a single fabric. The individual sections then had to be assembled into the complete garment, usually by sewing the various sections together, which was a very time and labor intensive process, and was often unsatisfactory to the wearer from both an aesthetic viewpoint since the resulting garment necessarily had a plurality of vertical seams around the perimeter of the garment where the individual modular sections were stitched together, which detracted from if not completely destroyed the "invisible" look of the garment since such seam lines were usually visible through the wearer's outer clothing; and from a comfort viewpoint because the plurality of seam lines generally tended to cause rubbing and chafing of the wearer's skin.

Accordingly, still other embodiments of the present invention relate to the preparation of such composite fabric laminates that enable the manufacture of garments that are still considered to be made from a single main piece, notwithstanding that the single main piece can be made from a number of different, but compatible, types of fabrics, both as to the horizontally adjacent sections of the garment and as to the vertically adjacent layers of a multi-layer fabric laminate.

The hot-melt technique utilized in the preparation of the multi-layer fabric laminates of the present invention wherein the several layers of the fabric laminate may be made from either the same or different fabrics, but wherein any given layer of the laminate is the same fabric over the entire surface of the laminate and thus also of the fabric blank and the final resulting garment made therefrom, as well as the technique of inserting other materials between the layers of the fabric laminate before gluing together of all of the layers and inserts of the fabric laminate, as disclosed and described hereinabove for the above-described embodiments of the invention, lend themselves to excellent adaptation to the fabrication of composite multi-layer fabric laminates.

In order to dispense with the need to sew the various modules of a composite fabric garment together, as has just been described to be the conventional technique of the prior art so as to eliminate the need for multiple seam lines in the final garment, and thereby also overcome the unaesthetic and uncomfortable aspects of most prior art composite fabric garments, the hereinabove described method for manufacturing multi-layer fabric laminates with entire single fabric layers of one fabric, it is necessary to be able to attach different fabrics to one another in a side-by side, edgewise adjacent manner, as well as in a surface-to-surface manner as is accomplished in the fabric laminates of the present invention already described hereinabove.

We have discovered that the highly favorable and beneficial aspect of garments constructed from fabric laminates made according to the present invention whereby the edges of the finished garment are highly resistant to unraveling and do not require seams or edge binding tapes, because of the excellent adhesion of the fabric layers in fabric laminates made according to the hereinabove described hot-melt process, and because of the provision of a selvage in the early blanks, which is later removed, as has been described, to further ensure that the edge of the final blank and garment made therefrom is completely and securely glued, that composite fabric laminate can be similarly made wherein the abutting edges of different fabrics on a particular surface of the composite fabric laminate do not split or separate, especially as the composite fabric laminate is repeatedly flexed or folded along such joints. Moreover, the joint or "seams" between the different fabrics are virtually invisible, do not add bulk to the garment, and can even be made in a variety of shapes and are not limited to straight lines. In order to achieve this virtually "seamless" appearance, adjacent fabrics should be overlapped at the line of juncture before being cut. The overlapped fabrics should then be cut together along the desired line. As mentioned, the line need not be a straight line, but can be composed of a plurality of straight line segments (e.g., zigzag), or may be simple or complex arcuate or curvilinear (e.g., scalloped). Where at least one layer of a composite fabric laminate is to be made from only a single fabric, and that layer is adjacent to the one or more other composite fabric layer(s) of the composite fabric laminate, the continuity of such single fabric layer is generally sufficient to provide sufficient backing or support for the composite fabric layers when the overall laminate is assembled and glued together. Where all layers of a multi-layer composite fabric laminate, however, are made from composite fabric combinations, it may still be possible to assemble and glue the final composite fabric laminate together without requiring the insertion of any "bridging" materials where the "seam" lines of adjacently different fabrics can be staggered from layer to layer of the final laminate so that such "seam" lines do not directly overlap or coincide with one another from one layer to another, since that would not provide adequate lateral support for enabling the adjacent fabrics to adhere to one another simultaneously on all layers of the laminate. Where, for whatever reasons, either mechanical and/or aesthetic, it is not possible to stagger the "seam" lines of abutting different fabrics in any given layer from one layer to another, but two or more or all sections of each layer of the garment are required or desired to have their "seam" lines aligned with one another (the last mentioned situation, where the seam lines of all layers of all sections are aligned being analogous to the "modular" sections fabricated for prior art composite fabric garments), it is necessary to use inserts of other materials between the layers of the composite fabric laminate to act as "bridging" material to provide adequate lateral basis for securely adhering all of the several horizontally or laterally abutting fabrics of each layer of the composite fabric laminate, as well as the vertically adjacent fabrics of the several layers of the composite fabric laminate, simultaneously to one another.

The technique of "bridging" abutting different fabrics of an individual layer and adjacent different fabrics of different layers is, however, relatively easy and utilizes an adaptation of the technique of inserting various stability, control, and shape providing materials in the "simple" fabric laminates of the present invention as previously described. The "bridging" technique involves the insertion of bridging pieces of material between layers of the composite fabric laminate at all coinciding "seam" lines of abutting different fabrics wherever adjacent layers of the composite fabric laminate are themselves made from different fabrics and at least one of the adjacent layers is not itself made from one continuous piece of a single fabric. Notwithstanding that the adhesive used to adhere the abutting different fabrics and adjacent different fabric layers of a composite fabric laminate according to the present invention may be in the form of a pre-cut blank of a thermoplastic adhesive resin web material, which spans all of the abutting different fabrics and adjacent different fabric layers when the composite fabric laminate blank is assembled for heat treatment to adhere the various fabrics and layers, the adhesive web blank and the adhesive material contained therein, even after the web melts to supply the molten adhesive, which in turn cools and sets to glue the various fabrics and layers together, generally does not itself provide sufficient lateral backing or support for the composite fabric laminate in any of its web, molten, or set states, thereby necessitating the insertion of the "bridging" material pieces.

The bridging material pieces inserted between layers of abutting and adjacent fabrics are similar to the gores and control inserts of other herein previously described embodiments of the invention. Although the bridging material pieces do not necessarily have to provide control or shape to the laminate and garment made therefrom, and so do not have to have the properties required of those materials, but merely act as a physical bridge or anchor for the various fabrics where they come together, and so are preferably made from any lightweight, pliable material with a sufficiently high tensile strength to resist tearing, they may nevertheless be made from the same materials used for a gore or control inserts of a garment, especially a brassiere, in those places where the need to provide a bridging piece and a gore or control insert is also required and thus serve a dual function.

The material used for the bridging pieces generally should not itself have a high elasticity, and, in any case, should have a lower modulus of elasticity than the fabrics that are being bridged.

Typical materials used for the bridging pieces include cotton, nylon and polyester. The bridging material insert pieces can alternatively be partial or continuous over the entire length of a joint or "seam" line between different abutting fabrics. Where they are not continuous, generally a plurality of pieces are used at predetermined intervals over the length of a joint line.

After the elements of the composite fabric laminate blank are assembled, including the various abutting fabrics of every layer, for each layer of the laminate, together with any bridging pieces and/or other inserted materials, such as, for example, channels and their associated underwires, gores, and control insert panels for a brassiere, or control insert panels for a panty, and the adhesive material, as a web or otherwise, the final composite fabric laminate blank is glued together in a hot-melt heat treatment step, and further fabricated and finished as necessary, according to the steps appropriate for the type of garment being made as previously disclosed and discussed hereinabove for other embodiments of the invention using other simple fabric laminates prepared according to the invention. Although the assembly steps for preparing blanks of composite fabric laminates are more labor intensive than for simple fabric laminates, it is still nevertheless possible to automate or semi-automate the process, using various mechanized and preferably computer-controlled assembly and manufacturing techniques and devices that will be apparent to persons of even ordinary skill in the art.

Referring now generally to FIGS. 16 A-H, several examples of various types of composite fabric laminates prepared according to the present invention, as just described, are illustrated.

FIG. 16 A is an exploded side cross-sectional view of a two-fabric-layer composite fabric laminate according to the present invention, wherein a first fabric layer 30 is made of a composite of alternating sections of two different abutting fabrics 30 *a*, 30 *b* and the second fabric layer 34 is made of a continuous piece of a single fabric which may be the same as or different from any of the fabrics used in the composite first fabric layer, and which acts as a supporting layer for the different fabrics of the first layer, such that bridging pieces are not required. A layer of adhesive material 32, which may be an adhesive web is also shown, such that the adhesive material will be in contact with the entire contacting facing surfaces of the two fabric layers of the composite fabric laminate when it is heat treated, and such that the two fabric layers will be glued together over their entire corresponding surfaces in the final composite fabric laminate, blank, and garment produced therefrom.

FIG. 16 B is an exploded side cross-sectional view of a two-fabric-layer composite fabric laminate according to the present invention that is configured substantially identically to the embodiment illustrated in FIG. 16 A, but wherein bridging insert pieces 45 *a, b* are nevertheless utilized to provide additional support and backing for the different abutting fabrics 30 *a, b* of the first fabric layer 30.

FIG. 16 C is an exploded side cross-sectional view of a two-fabric-layer composite fabric laminate according to the present invention, wherein both the first fabric layer 30 and the second fabric layer 34 are made of a composite of alternating sections of two different abutting fabrics 30 *a*, 30 *b* and 34 *a*, 34 *b*, which, with respect to the two layers, may be all or partially the same fabrics or are all different fabrics, wherein the "seam" lines between abutting fabrics in the first fabric layer do not align and coincide with, or are "staggered" with the "seam" lines between abutting fabrics in the second fabric layer, so that bridging inserts are not required to provide stability and supporting surfaces to hold the abutting fabrics and the adjacent fabric layers together in the final assembled and glued composite fabric laminate, because the seams of one layer do not overlap with the seams of another layer, but have a continuous section of fabric of another layer therebeneath for support and stability. A layer of adhesive material 32, which may be an adhesive web is also shown, such that the adhesive material will be in contact with the entire contacting facing surfaces of the two fabric layers of the composite fabric laminate when it is heat treated, and such that the two fabric layers will be glued together over their entire corresponding surfaces in the final composite fabric laminate, blank, and garment produced therefrom.

FIG. 16 D is an exploded side cross-sectional view of a two-fabric-layer composite fabric laminate according to the present invention, wherein both the first fabric layer 30 and the second fabric layer 34 are made of a composite of alternating sections of two different abutting fabrics 30 *a*, 30 *b* and 34 *a*, 34 *b*, which, with respect to the two layers, may be all or partially the same fabrics or are all different fabrics, wherein the "seam" lines between abutting fabrics in the first fabric layer align and coincide with the "seam" lines between abutting fabrics in the second fabric layer, so that bridging inserts are not required to provide stability and supporting surfaces to hold the abutting fabrics and the adjacent fabric layers together in the final assembled and glued composite fabric laminate, because the seams of one layer do not overlap with the seams of another layer. A layer of adhesive material 32, which may be an adhesive web is also shown, such that the adhesive material will be in contact with the entire contacting facing surfaces of the two fabric layers of the composite fabric laminate when it is heat treated, and such that the two fabric layers will be glued together over their entire corresponding surfaces in the final composite fabric laminate, blank, and garment produced therefrom. In this embodiment of a composite fabric laminate according to the present invention, it is generally sufficient that the bridging insert pieces be placed between one of the fabric layers and the adhesive material (the inserts are shown between the first fabric layer 30 and the adhesive material 34 in FIG. 16 D) when the composite fabric laminate is assembled, since in the course of heat-treating the assembled fabric laminate blank, wherein the adhesive is first melted and then sets to glue together the various fabrics of the several layers, as well as any other materials inserted therebetween, the adhesive will come to surround both sides of the bridging pieces and also contact the facing surfaces of the adjacent fabric layers so that a sufficiently strong bond forms as between the bridging material inserts and both fabric layers. In a variant of this embodiment, not shown, the bridging material insert pieces could instead be inserted between the second fabric layer 34 and the adhesive material 32. As a still further alternative, however, separate bridging pieces 45 *a-d* are inserted on both sides of the adhesive 32, proximate to the abutting fabrics of each of the adjacent fabric layers 30, 34, so as to provide even greater stability and additional contacting surfaces for all of the fabric elements, as is shown in FIG. 16 E, which is an exploded side cross-sectional view of this embodiment of composite fabric laminate, which is otherwise identical to that shown in FIG. 16 D.

FIG. 16 F is an exploded side cross-sectional view of still another two-fabric-layer composite fabric laminate according to the present invention, wherein both the first fabric layer 30 and the second fabric layer 34 are made of a composite of alternating sections of two different abutting fabrics 30 *a*, 30 *b* and 34 *a*, 34 *b*, which, with respect to the two layers, may be all or partially the same fabrics or are all different fabrics, wherein the "seam" lines between abutting fabrics in the first fabric layer align and coincide with the "seam" lines between abutting fabrics in the second fabric layer, so that bridging inserts 45 *a, b* are required to provide stability and supporting surfaces to hold the abutting fabrics and the adjacent fabric layers together in the final assembled and glued composite fabric laminate, which is, however, not completely glued over the entire facing surfaces of the two composite fabric layers, and is not glued in certain selected portions. A layer of adhesive material 32, which may be an adhesive web, is also shown, such that adhesive is present only in certain designated portions 32 *a* and is absent in other designated portions 32 *b*, such that the adhesive material will be in contact with only selected portions of the entire contacting facing surfaces of the two fabric layers of the composite fabric laminate when it is heat treated, and such that the two fabric layers will be-glued together over only those portions of their entire corresponding surfaces that are exposed to and are in, communication with the adhesive in the final composite fabric laminate, blank, and garment produced therefrom, and the two fabric layers will not be glued together or adhere in those portions that have not been exposed to adhesive. In this embodiment of a composite fabric laminate according to the present invention, it is also necessary to provide bridging material insert pieces to provide stability and supporting surfaces to hold the abutting fabrics and the adjacent fabric layers together in the final assembled and glued composite fabric laminate. The bridging material insert pieces are shown here as being provided on both sides of the adhesive material 45 *a-d*, although, alternatively, the bridging material insert pieces could be provided only on one or the other sides of the adhesive material, between either one of the fabric layers and the adhesive material, analogous to the embodiment shown in FIG. 16 D or as described as an alternative thereto.

Still other variations of composite fabric laminates according to the present invention, including, but not limited to composite fabric laminates having greater than two fabric layers, not here illustrated, will be apparent to persons of ordinary skill in the art from the foregoing.

While the present invention is disclosed with reference to specific embodiments and the particular details thereof, it is not intended that those details be construed as limiting the scope of the invention, which is defined by the following claims.

What is claimed is:

1. A composite fabric laminated blank for making an undergarment portion, comprising:

a first fabric layer having an inner surface;

a second fabric layer having an inner surface; and the first and second fabric layers being bonded together by an adhesive to define a laminated blank having an outer periphery and area within the outer periphery in the general shape of one of a brassiere and panty undergarment portion, and that is larger than an outer periphery and area within the outer periphery in a shape of a final undergarment portion.

2. The composite fabric laminated blank of claim 1, wherein each of the first and second fabric layers has a selected degree of elasticity.

3. The composite fabric laminated blank of claim 1, wherein the adhesive is a resin selected from the group consisting of a film, a web, and a dry powder.

4. The composite fabric laminated blank of claim 3, wherein the adhesive resin is a thermoplastic adhesive resin selected from the group consisting of polyamides and polyurethanes.

5. The composite fabric laminated blank of claim 4, wherein the polyamide thermoplastic adhesive is a ternary elastomeric material having a melting point between about 105 degrees C. and 175 degrees C.

6. The composite fabric laminated blank of claim 1, wherein the brassiere portion further comprises a pair of breast-receiving cups.

* * * * *